US009964879B2

(12) United States Patent
Terui et al.

(10) Patent No.: US 9,964,879 B2
(45) Date of Patent: May 8, 2018

(54) TONER AND METHOD FOR PRODUCING TONER

(71) Applicant: CANON KABUSHIKI KAISHA, Tokyo (JP)

(72) Inventors: Yuhei Terui, Numazu (JP); Yu Yoshida, Mishima (JP); Haruko Kubo, Fukui (JP); Hitoshi Itabashi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/457,054

(22) Filed: Mar. 13, 2017

(65) Prior Publication Data

US 2017/0269491 A1 Sep. 21, 2017

(30) Foreign Application Priority Data

Mar. 18, 2016 (JP) ..... 2016-055202

(51) Int. Cl.
*G03G 9/08* (2006.01)
*G03G 9/087* (2006.01)
*G03G 9/09* (2006.01)

(52) U.S. Cl.
CPC ..... *G03G 9/08711* (2013.01); *G03G 9/0804* (2013.01); *G03G 9/08755* (2013.01); *G03G 9/08797* (2013.01); *G03G 9/0904* (2013.01); *G03G 9/0918* (2013.01)

(58) Field of Classification Search
CPC ..... G03G 9/08711; G03G 9/0804; G03G 9/08755; G03G 9/08797
USPC ..... 430/109.1, 111.4
See application file for complete search history.

(56) References Cited

U.S. PATENT DOCUMENTS

| | | | |
|---|---|---|---|
| 5,494,770 | A | 2/1996 | Baba et al. |
| 5,573,880 | A | 11/1996 | Mayama et al. |
| 5,576,133 | A | 11/1996 | Baba et al. |
| 5,744,278 | A | 4/1998 | Ayaki et al. |
| 5,985,502 | A | 11/1999 | Ayaki et al. |
| 6,083,655 | A | 7/2000 | Itabashi et al. |
| 6,106,990 | A | 8/2000 | Tazawa et al. |
| 6,124,070 | A | 9/2000 | Baba et al. |
| 6,165,663 | A | 12/2000 | Baba et al. |
| 6,500,593 | B2 | 12/2002 | Abe et al. |
| 6,566,028 | B2 | 5/2003 | Tazawa et al. |
| 6,689,525 | B2 | 2/2004 | Itabashi |
| 6,790,576 | B2 | 9/2004 | Fujimoto et al. |
| 6,808,855 | B2 | 10/2004 | Ayaki et al. |
| 7,323,282 | B2 | 1/2008 | Ohno et al. |
| 8,053,156 | B2 | 11/2011 | Abe et al. |
| 8,178,275 | B2 | 5/2012 | Tani et al. |
| 8,383,312 | B2 | 2/2013 | Fujimoto et al. |
| 8,440,382 | B2 | 5/2013 | Isono et al. |
| 8,497,054 | B2 | 7/2013 | Sugiyama et al. |
| 8,574,801 | B2 | 11/2013 | Itabashi et al. |
| 8,609,312 | B2 | 12/2013 | Itabashi et al. |
| 8,652,725 | B2 | 2/2014 | Watanabe et al. |
| 8,652,737 | B2 | 2/2014 | Handa et al. |

(Continued)

FOREIGN PATENT DOCUMENTS

| | | |
|---|---|---|
| JP | S63-270060 | 11/1988 |
| JP | 2004-045654 | 2/2004 |

(Continued)

*Primary Examiner* — Mark A Chapman
(74) *Attorney, Agent, or Firm* — Fitzpatrick Cella Harper and Scinto

(57) ABSTRACT

Provided is a toner comprising a toner particle containing a binder resin, a resin A, and a pigment, wherein the resin A has a pKa of at least 6.0 and not more than 9.0, and also has a hydrophobic parameter HPA of at least 0.65 and not more than 0.95.

12 Claims, 1 Drawing Sheet

(56) References Cited

U.S. PATENT DOCUMENTS

| | | | |
|---|---|---|---|
| 8,778,581 | B2 | 7/2014 | Nonaka et al. |
| 8,828,633 | B2 | 9/2014 | Itabashi et al. |
| 8,916,319 | B2 | 12/2014 | Ikeda et al. |
| 8,940,467 | B2 | 1/2015 | Hashimoto et al. |
| 8,975,000 | B2 | 3/2015 | Tani et al. |
| 9,029,056 | B2 | 5/2015 | Kenmoku et al. |
| 9,098,002 | B2 | 8/2015 | Kenmoku et al. |
| 9,098,003 | B2 | 8/2015 | Masumoto et al. |
| 9,158,216 | B2 | 10/2015 | Shimano et al. |
| 9,229,345 | B2 | 1/2016 | Ikeda et al. |
| 9,377,705 | B2 | 6/2016 | Shimano et al. |
| 9,383,668 | B2 | 7/2016 | Noji et al. |
| 9,575,424 | B2 | 2/2017 | Nakagawa et al. |
| 9,599,919 | B2 | 3/2017 | Isono et al. |
| 9,632,441 | B2 | 4/2017 | Abe et al. |
| 2012/0172562 | A1 | 7/2012 | Kenmoku et al. |
| 2013/0065174 | A1 | 3/2013 | Itabashi et al. |
| 2015/0099220 | A1 | 4/2015 | Abe et al. |
| 2015/0099222 | A1 | 4/2015 | Terui et al. |
| 2015/0153669 | A1 | 6/2015 | Yoshida et al. |
| 2015/0370189 | A1 | 12/2015 | Tanaka et al. |
| 2016/0246192 | A1 | 8/2016 | Yoshida et al. |
| 2016/0349646 | A1 | 12/2016 | Yoshida et al. |
| 2017/0052465 | A1 | 2/2017 | Shimano et al. |

FOREIGN PATENT DOCUMENTS

| | | |
|---|---|---|
| JP | 2005-181835 | 7/2005 |
| JP | 2005-215501 | 8/2005 |
| JP | 2007-131832 | 5/2007 |
| JP | 5241939 | 7/2013 |

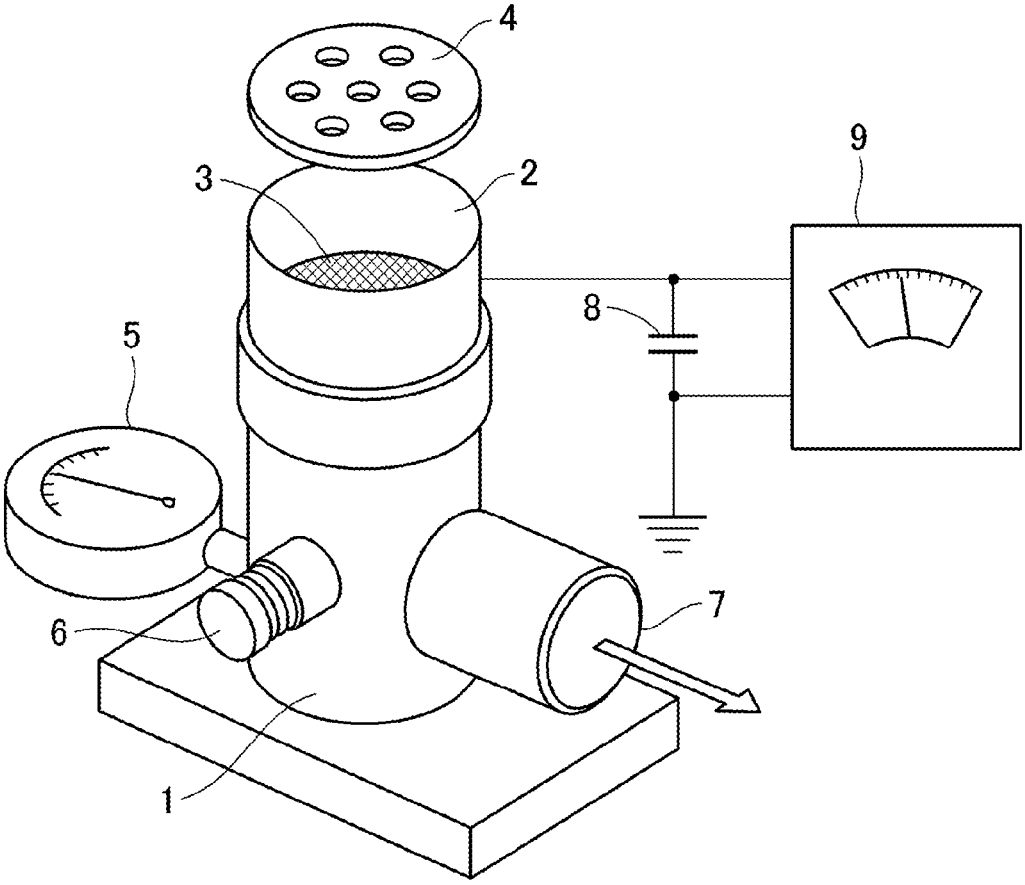
4
3
2
9
8
5
6
7
1

TONER AND METHOD FOR PRODUCING TONER

BACKGROUND OF THE INVENTION

Field of the Invention

The present invention relates to a toner for developing an electrostatic image which is used in an image formation method such as electrophotography and electrostatic printing, and also to a method for producing the toner.

Description of the Related Art

The development of electrophotographic techniques used in printers and copiers has been continued in recent years, and a demand has been created for reduction of the devices in weight, size, and energy consumption. Meanwhile, a demand is also strong for high-quality and high-definition toners with high image reproducibility. To meet such demands, it is necessary to increase tinting strength, increase definition, and improve development stability.

Japanese Patent Application Publication No. 2005-215501 suggests increasing the amount of a colorant in a toner as a means for increasing the tinting strength. Further, a method for increasing the tinting strength and also increasing chroma and lightness by raising pigment dispersibility can be also used to increase further the image definition. A pigment dispersant is used in such a method, and a large number of pigment dispersants have been development. Japanese Patent Application Publication No. 2005-181835 discloses a pigment dispersant using acid-base interaction of a pigment and a pigment dispersant.

Meanwhile, from the standpoint of development stability, there is a strong demand for a toner with excellent charging characteristics. Japanese Patent No. 5241939 discloses a charge control agent which is a salicylic acid derivative for obtaining excellent charging characteristics.

SUMMARY OF THE INVENTION

However, although the toner disclosed in Japanese Patent Application Publication No. 2005-215501 demonstrates a high tinting strength, since the lightness decreases with the increase in the amount of pigment, there is still room for improvement in terms of color reproducibility. Further, as the amount of the toner added is increased, charging performance under a high temperature and a high humidity is degraded.

With the pigment dispersant disclosed in Japanese Patent Application Publication No. 2005-181835, pigment dispersibility is increased, but the dispersant has strong polarity, causes pigment aggregation in a toner particle, and does not improve the tinting strength to the required level. In addition, the charging performance of the toner varies significantly under a high-temperature and high-humidity environment and a low-temperature and low-humidity environment, and the environmental stability is insufficient.

Meanwhile in Japanese Patent No. 5241939, excellent charge rising performance is obtained, but when the amount of pigment is increased, the charge control agent can be adsorbed by the pigment and can form self-associations therewith, which can result in pigment aggregation. As a result, the decrease in charge retention performance caused by pigment aggregation can lead to decrease in environmental stability.

It is a task of the present invention to resolve the above-described problems. Thus, it is an objective to provide a toner that excels in tinting strength and lightness, has high color reproducibility, and also demonstrates charging characteristics with excellent environmental stability and has high image reproducibility under various environments, and also to provide a method for producing the toner.

The results of the comprehensive research conducted by the inventors have demonstrated that a toner that resolves the above-described problems can be obtained by controlling the hydrophobicity of a resin having a specific acid dissociation constant pKa.

The present invention relates to a toner comprising a toner particle containing: a binder resin, a resin A, and a pigment, wherein the resin A has a pKa of at least 6.0 and not more than 9.0, the resin A has a hydrophobic parameter HPA of at least 0.65 and not more than 0.95.

Here, the pKa represents an acid dissociation constant measured by preparing a resin solution in which 1.0 part by mass of the resin A, 70.0 parts by mass of toluene and 30.0 parts by mass of ethanol are mixed, and carrying out neutralization titration with a 0.1 mol/L potassium hydroxide ethanol solution.

The HPA represents a volume fraction of heptane at a point of precipitation by the resin A as measured by the addition of heptane to a solution containing 0.01 parts by mass of the resin A and 1.48 parts by mass of chloroform.

The present invention also relates to a toner production method for producing the abovementioned toner, the production method comprising the following step (i) or (ii);

(i) a step of producing a toner particle by granulating, in an aqueous medium, a polymerizable monomer composition containing the resin A, the pigment and a vinyl polymerizable monomer capable of forming the binder resin, and polymerizing the vinyl polymerizable monomer contained in the polymerizable monomer composition; and (ii) a step of producing a toner particle by granulating, in an aqueous medium, an organic solvent dispersion containing the binder resin, the resin A, and the pigment in an organic solvent.

The present invention can provide a toner that excels in tinting strength and lightness, has high color reproducibility, and also demonstrates charging characteristics with excellent environment stability and has high image reproducibility under various environments, and also a method for producing the toner.

Further features of the present invention will become apparent from the following description of exemplary embodiments (with reference to the attached drawings).

BRIEF DESCRIPTION OF THE DRAWINGS

The FIGURE shows an example of a device for measuring a charge quantity.

DESCRIPTION OF THE EMBODIMENTS

The embodiments of the present invention are described hereinbelow, but the present invention is not intended to be limited to these embodiments.

In the present invention, the expressions "at least oo and not more than xx" and "oo to xx" representing numerical ranges are intended to represent numerical ranges including lower and upper limits which are the end points thereof, unless specifically stated otherwise.

In order to obtain the satisfactory charging characteristics of a toner with increased amount of a pigment, the inventors conducted a comprehensive study of resins having acidic functional groups, such as disclosed in Japanese Patent No. 5241939. As a result, it was found that the resin A, which is explained hereinbelow in detail, combines superior charging characteristics with a pigment aggregation suppressing effect. This finding led to the creation of the present invention.

A mechanism of the effects demonstrated by the invention is considered hereinbelow.

The resin A has a weak acidity as a result of the pKa being at least 6.0 and not more than 9.0. The pKa of the resin A is measured by titration with a basic solution in an organic solvent, and the resin A demonstrates acidic behavior in a region in which pH in the organic solvent is not more than pKa. This is due to the acidic functional groups of the resin A. As a result, adsorptivity into the pigment and charge retention performance are demonstrated.

Further, the resin A has the hydrophobic parameter HPA of at least 0.65 and not more than 0.95. By controlling the HPA to at least 0.65, it is possible to increase the hydrophobicity of the pigment surface which has adsorbed the resin A. As a result, aggregation of pigment particles can be suppressed by the hydrophobic resin A adsorbed by the pigment, and the charge-controlled pigment particles can be uniformly dispersed.

The HPA represents a volume fraction of heptane at a point of precipitation by the resin A as measured by the addition of heptane to a solution containing 0.01 parts by mass of the resin A and 1.48 parts by mass of chloroform.

Next, the pKa of the resin A is explained. A method for determining the pKa of the resin A will be described hereinbelow, but the pKa of the resin A needs to be at least 6.0 and not more than 9.0. The pKa is an acid dissociation constant measured by preparing a solution in which 1.0 part by mass of the resin A, 70.0 parts by mass of toluene and 30.0 parts by mass of ethanol are mixed, and carrying out neutralization titration with a 0.1 mol/L potassium hydroxide ethanol solution.

From the standpoint of charging characteristics, where the pKa is at least 6.0, the resin A does not excessively interact with moisture. Therefore, the charge quantity does not decrease under a high-temperature and high-humidity environment and the difference with the charge quantity under a low-temperature and low-humidity environment decreases. Meanwhile, where the pKa is not more than 9.0, sufficient acidity is demonstrated. Therefore, excellent negative charging performance is demonstrated and a sufficient charge quantity can be obtained under a low-temperature and low-humidity environment and a high-temperature and a high-humidity environment.

From the standpoint of pigment dispersibility, where the pKa is less than 6.0, the acidity of the resin A becomes too strong, and where the pKa is greater than 9.0, the basicity of the resin A becomes too strong. As a result, the resin is likely to be strongly influenced by other materials with a high polarity or by a toner production process and loses the ability to interact with the pigment. Therefore, the effect of increasing the tinting strength cannot be obtained.

It is preferred that the pKa of the resin A be at least 7.0 and not more than 8.0, because even better environmental stability of charge and acid-base interaction of the resin and the pigment can be obtained.

A method for controlling the pKa of the resin A is explained hereinbelow. The control can be performed by the structure of linker groups and functional groups of the resin A and by the molecular weight of the resin A.

Where the hydrophobic parameter HPA of the resin A is less than 0.65, the resin is likely to be affected by other polar materials in the toner production process or changes in environment in the production process. Therefore, the interaction between the resin A and the pigment cannot be maintained, thereby causing aggregation of the pigment. Further, since the moisture adsorption ability of the toner increases, the decrease in charge under a high-temperature and high-humidity environment increases. It is preferred that the HPA be at least 0.70 and not more than 0.95.

A method for controlling the hydrophobic parameter HPA of the resin A is explained in detail on the basis of the below-described method, but the control can be performed by the structure of the functional groups of the resin A, the number of the functional groups and the structure of the main chain.

It is preferred that the resin A have a structure represented by formula (1) below.

(1)

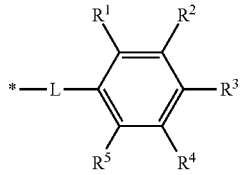

In formula (1), one of $R^2$ and $R^3$ is a carboxyl group. $R^1$, $R^2$, $R^3$, $R^4$, and $R^5$ other than the carboxyl group are independently a hydrogen atom, a hydroxyl group, an amino group, an alkoxy group having at least 1 and not more than 8 carbon atoms, or an alkyl group having at least 1 and not more than 8 carbon atoms. L is a linker group represented by formula (2). * represents a segment bonded to the main chain skeleton of the resin A.

(2)

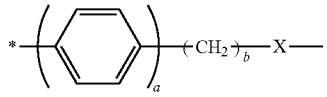

In formula (2), a is 0 or 1, and b is an integer of at least 0 and not more than 4. X is a single bond or a group represented by any one of —O—, —S—, and —$NR^6$—. $R^6$ is a hydrogen atom or an alkyl group having at least 1 and not more than 4 carbon atoms. * represents a segment bonded to the main chain skeleton of the resin A.

The carboxyl group in formula (1) is a segment interacting with the pigment, and it is preferred that one of $R^2$ and $R^3$ be a carboxyl group. Where one of $R^2$ and $R^3$ is a carboxyl group, the distance from the main chain skeleton is increased and, therefore, steric hindrance in the interaction can be reduced. When the group other than the carboxyl group is an alkoxy group having at least 1 and not more than 8 carbon atoms or an alkyl group having at least 1 and not more than 8 carbon atoms, from the standpoint of steric hindrance in interaction with the pigment, an alkoxy group having at least 1 and not more than 4 carbon atoms or an alkyl group having at least 1 and not more than 4 carbon atoms is more preferred.

It is preferred that a in formula (2) be 1. When a is 1, the distance to the main chain skeleton can be appropriately controlled. Therefore, interaction with the pigment is likely to increase. For the same reason, it is preferred that b be at least 1 and not more than 4. Further, it is preferred that X be —O— because the electron-donating character is enhanced and, therefore, the pKa determined by the carboxyl group in formula (1) is further increased.

The structure represented by formula (1) is preferably a structure represented by formula (3) below.

(3)

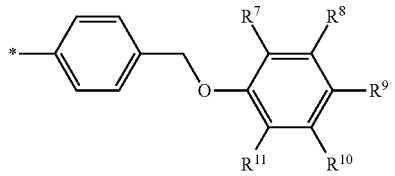

In formula (3), one of $R^8$ and $R^9$ is a carboxyl group, and the other is a hydroxyl group. $R^7$, $R^{10}$, and $R^{11}$ are independently a hydrogen atom, a hydroxyl group, an amino group, an alkoxy group having at least 1 and not more than 4 carbon atoms, or an alkyl group having at least 1 and not more than 4 carbon atoms. * represents a segment bonded to the main chain skeleton of the resin A. It is preferred that the resin A have the structure represented by formula (1) (preferably formula (3)) in a side chain.

The structure represented by formula (1) above is preferably the structure represented by formula (3) above for the abovementioned reason and also because the pKa derived from the carboxyl group is further increased by the electron-donating character of the hydroxyl group.

The main chain skeleton of the resin A may be any polymer. For example, a vinyl polymer, a polyester polymer, a polyamide polymer, a polyurethane polymer, or a polyether polymer. Among them, from the standpoint of easiness of production, a vinyl polymer and a polyester polymer are preferred.

Further, from the standpoint of easiness of hydrophobic parameter control, a vinyl polymer is more preferred. When a vinyl polymer is used as the resin A in the present invention, the resin A can be obtained, for example, by the following methods. A method of copolymerizing a vinyl monomer and a compound into which a polymerizable functional group, such as represented by formula (4) below, has been introduced, and a method of introducing acidic functional groups into a polymer obtained in advance by copolymerizing monomers which form the main chain skeleton.

(4)

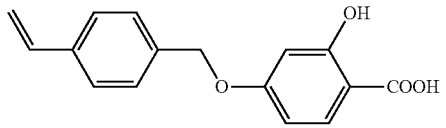

When a vinyl polymer is used as the resin A, it is preferred that the structure represented by formula (1) be represented, for example, by formula (4-1) below.

(4-1)

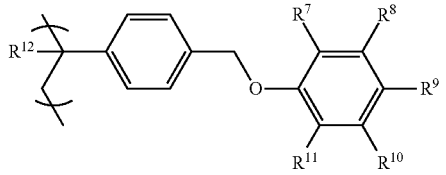

In formula (4-1), $R^7$ to $R^{11}$ are the same as described above. $R^{12}$ represents a hydrogen atom or a methyl group.

A vinyl monomer to be used for the resin A is not particularly limited. It is preferred that the following vinyl monomers be used as monomers for the main chain skeleton of the resin A.

Specific examples include aromatic vinyl monomers such as styrene, o-methylstyrene, m-methylstyrene, p-methylstyrene, and α-methylstyrene; ethylene unsaturated monoolefin monomers such as ethylene, propylene, butylene, and isobutylene; halogenated vinyl monomers such as vinyl chloride, vinylidene chloride, vinyl bromide, and vinyl fluoride; vinyl ester acid monomers such as vinyl acetate, vinyl propionate, and vinyl benzoate; acrylic acid monomers such as acrylic acid, methyl acrylate, ethyl acrylate, propyl acrylate, butyl acrylate, 2-ethylhexyl acrylate, octyl acrylate, dodecyl acrylate, stearyl acrylate, behenyl acrylate, hydroxyethyl acrylate, hydroxypropyl acrylate, glycidyl acrylate, and benzyl acrylate; and methacrylic acid monomers such as methacrylic acid, methyl methacrylate, ethyl methacrylate, propyl methacrylate, butyl methacrylate, 2-ethylhexyl methacrylate, octyl methacrylate, dodecyl methacrylate, stearyl methacrylate, behenyl methacrylate, hydroxyethyl methacrylate, hydroxypropyl methacrylate, glycidyl methacrylate, and benzyl methacrylate. These monomers can be used individually or in combinations of two or more thereof.

A composite polymer having a polyester structure and a vinyl polymer structure may be the main chain skeleton of the resin A. Specific examples include a composite polymer in which a vinyl polymer structure is grafted onto a polyester main chain and a composite polymer having a structure in which a polyester structure and a vinyl polymer structure are bonded in blocks.

In order to increase the hydrophobic parameter HPA and control it to the range of the present invention, it is preferred that the resin A further have an alkoxycarbonyl group represented by formula (5) below.

(5)

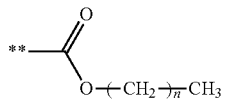

Here, n is preferably at least 3 and not more than 21. Where n is at least 3, the hydrophobic parameter HPA of the resin A is easily controlled, and when n is not more than 21, the acidic functional groups of the resin A do not act as steric hindrances in acid-base interaction with the pigment. Here, ** represents a segment bonded to the main chain skeleton of the resin A.

An alkyl ester of acrylic acid or methacrylic acid which has at least 3 and not more than 21 carbon atoms is preferred as a monomer including an alkoxycarbonyl group from which the structure of formula (5) is to be derived. Examples of such monomers include butyl acrylate, stearyl acrylate, behenyl acrylate, butyl methacrylate, stearyl methacrylate, and behenyl methacrylate. The content of the monomer unit including the structure of formula (5) is preferably at least 2.00 mol % and not more than 30.00 mol % on the basis of all monomer units of the resin A.

The acid value of the resin A of the present invention is preferably at least 3.0 mg KOH/g and not more than 25.0 mg KOH/g, and more preferably at least 5.0 mg KOH/g and not more than 20.0 mg KOH/g. When the acid value is at least 3.0 mg KOH/g, the number of acidic functional groups that hold the charge is sufficient. Therefore, the desired charge quantity is likely to be obtained. Further since there is a sufficient portion interacting with the pigment, the tinting strength and lightness are likely to be increased. Where the acid value is not more than 25.0 mg KOH/g, hydrophilicity caused by the functional groups of the resin A is small and, therefore, the hydrophobic parameter can be easily controlled. The acid value of the resin A can be controlled by the amount of introduced acidic functional groups.

The content of the resin A is preferably at least 3.0 parts by mass and not more than 30.0 parts by mass, more preferably at least 5.0 parts by mass and not more than 25.0 parts by mass per 100 parts by mass of the pigment. Where the resin content is at least 3.0 parts by mass, this amount is sufficient for obtaining the charge quantity and a sufficient amount of the resin A can interact with the pigment. Therefore, the tinting strength and heat-resistant storability are likely to increase. Where the resin content is not more than 30.0 parts by mass, the occurrence of pigment aggregation because of increasing the polarity of the system by components which are not adsorbed by the pigment can be suppressed. Therefore, the tinting strength is likely to be increased.

The weight-average molecular weight (Mw) of the resin A is preferably at least 10,000 and not more than 75,000, and more preferably at least 15,000 and not more than 45,000. Where Mw is at least 10,000, acid dissociation is unlikely to proceed because the size of the molecule of the resin A is sufficient. Thus, the pKa is likely to further increase. It is preferred that Mw be not more than 75,000 because a high affinity for the below-described resin B is demonstrated and, therefore, better affinity between the binder resin and the pigment is obtained and the aggregation suppression effect is demonstrated.

The Mw of the resin A can be controlled by changing, for example, the reaction temperature, reaction time, loading ratio of monomers, and initiator amount during polymerization.

In the present invention, it is preferred that the binder resin include 50 parts by mass or more of a resin B when the resin component in the toner is taken as 100 parts by mass. The upper limit is not particularly limited, but it is preferred that it be not more than 97 parts by mass. It is also preferred that the difference (HPB−HPA) between the hydrophobic parameter HPB of the resin B and the hydrophobic parameter HPA of the resin A be at least −0.10 and not more than 0.25.

A small difference between HPA and HPB represents a high affinity between the resin A and the resin B.

It is considered that where the affinity is high, the two resins are in a satisfactory compatible state. It is also considered that where such a resin B is the main component of the resin, the resin A can be uniformly dispersed in the toner, thereby making it possible to maximize the effect of the present invention.

The HPB represents a volume fraction of heptane at a point of precipitation by the resin B as measured by the addition of heptane to a solution containing 0.01 parts by mass of the resin B and 1.48 parts by mass of chloroform.

It is more preferred that the content of the resin B be at least 60 parts by mass when the resin components in the toner are taken as 100 parts by mass. Further, it is more preferred that (HPB−HPA) be at least −0.05 and not more than 0.22.

The hydrophobic parameter HPB of the resin B can be controlled by the composition constitution the resin B.

Next, the pigment used in the present invention is explained.

The pigment used in the present invention is preferably a pigment with a high 7 flatness. It is particularly preferred that the pigment be at least one selected from the group consisting of carbon black, a phthalocyanine pigment, a quinacridone pigment, a pyrrolopyrrole pigment, a perylene pigment, an anthraquinone pigment, and an isoindoline pigment.

Examples of the preferred pigments include carbon black, C. I. Pigment Blue 15, C. I. Pigment Blue 15:3, C. I. Pigment Red 122, C. I. Pigment Red 264, and solid solution of these pigments with other pigments.

The amount added of the pigment may be changed, as appropriate, in order to obtain satisfactory tinting strength and lightness and also excellent color reproducibility. The amount added of the pigment is preferably at least 3.0% by mass and not more than 20.0% by mass, and more preferably at least 5.0% by mass and not more than 12.5% by mass on the basis of the total mass of the toner.

Next, a method for producing the toner of the present invention is explained. The toner of the present invention can be produced by the conventional well-known methods. For example, the following methods can be used: a suspension polymerization method in which a polymerizable monomer composition containing a pigment, a resin A, a polymerizable monomer for obtaining a binder resin, and optionally a release agent, or the like, is suspended and granulated in an aqueous medium, and the polymerizable monomer contained in the polymerizable monomer composition is polymerized; a kneading and pulverization method in which toner constituent materials including a binder resin, a pigment, and a resin A are kneaded, pulverized and classified; an emulsion aggregation method in which a dispersion in which a binder resin is emulsified and dispersed, a pigment dispersion containing a pigment and a resin A, and optionally a dispersion of a release agent, or the like, are mixed, aggregated, and fused by heating to obtain a toner particle; an emulsion polymerization aggregation method in which a dispersion formed by emulsion polymerization of a polymerizable monomer constituting a binder resin, a pigment dispersion containing a pigment and a resin A, and optionally a dispersion of a release agent, or the like, are mixed, aggregated, and fused by heating to obtain a toner particle; and a dissolution suspension method in which an organic solvent dispersion containing a binder resin, a pigment, a resin A, and optionally a release agent, or the like, in an organic solvent is suspended and granulated in an aqueous medium.

In particular, with the production method including a step of uniformly mixing a toner composition in an oil phase, since a resin A, a binder resin, and a pigment are uniformly mixed, the dispersibility of the pigment in the binder resin is improved. Therefore, the suspension polymerization method and dissolution suspension method are preferred. Thus, in the present invention, a production method including the following step (i) or (ii) is preferred:

(i) a step of producing a toner particle by granulating, in an aqueous medium, a polymerizable monomer composition containing a resin A, a pigment, and a vinyl polymerizable monomer capable of forming the binder resin, and polymerizing the vinyl polymerizable monomer contained in the polymerizable monomer composition; and (ii) a step of producing a toner particle by granulating, in an aqueous medium, an organic solvent dispersion containing the binder resin, the resin A, and the pigment in an organic solvent.

Next, the resin B will be explained. The resin B may be any polymer. For example, a vinyl polymer, a polyester polymer, a polyamide polymer, a polyurethane polymer, a polyether polymer, a maleic acid copolymer, and an epoxy resin. Among them, from the standpoint of easiness of production, a vinyl polymer and a polyester polymer are preferred. In the present invention, it is preferred that the resin B be the main component of the resin in the toner, and the abovementioned resins may be used in addition to the resin B as the binder resin.

The vinyl polymer is a resin obtained by polymerizing a radical-polymerizable vinyl monomer.

Examples of the vinyl monomer include styrene and styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, and p-n-hexylstyrene, p-n-octylstyrene, p-n-nonylstyrene, p-n-decylstyrene, p-n-dodecylstyrene, p-methoxystyrene, and p-phenylstyrene;

acryl polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphate ethyl acrylate, diethylphosphate ethyl acrylate, dibutylphosphate ethyl acrylate, and 2-benzoyloxyethyl acrylate; and methacryl polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphate ethyl methacrylate, and dibutylphosphate ethyl methacrylate.

Examples of polyfunctional polymerizable monomers include diethylene glycol diacrylate, triethylene glycol diacrylate, tetraethylene glycol diacrylate, polyethylene glycol diacrylate, 1,6-hexane diol diacrylate, neopentyl glycol diacrylate, tripropylene glycol diacrylate, polypropylene glycol diacrylate, 2,2'-bis(4-(acryloxydiethoxy)phenyl)propane, trimethylol propane triacrylate, tetramethylol methane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexane diol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinyl benzene, divinyl naphthalene, and divinyl ether.

These compounds can be used individually or in combinations of two or more thereof.

Polyvalent carboxylic acids and polyhydric alcohols can be used as polycondensation monomers suitable for polyester polymers.

Examples of polyvalent carboxylic acids include oxalic acid, glutaric acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-dicarboxylic acid, hexahydroterephthalic acid, malonic acid, pimelic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and cyhclohexanedicarboxylic acid. Examples of polyvalent carboxylic acids other than dicarboxylic acids include trimellitic acid, pyromellitic acid, naphthalenetricarboxylic acid, naphthalenetetracarboxylic acid, pyrenetricarboxylic acid, and pyrenetetracarboxylic acid.

Examples of polyhydric alcohols include ethylene glycol, diethylene glycol, triethylene glycol, 1,2-propane diol, 1,3-propane diol, 1,4-butane diol, neopentyl glycol, 1,4-butene diol, 1,5-pentane diol, 1,6-hexane diol, 1,4-cyclohexane dimethanol, dipropylene glycol, polyethylene glycol, polypropylene glycol, polytetramethylene glycol, sorbitol, 1,2,3,6-hexane tetrol, 1,4-sorbitan, pentaerythritol, dipentaerythritol, tripentaerythritol, 1,2,4-butane triol, 1,2,5-pentane triol, glycerol, 2-methylpropane triol, 2-methyl-1,2,4-butane triol, trimethylolethane, trimethylolpropane, 1,3,5-trihydroxymethylbenzene, bisphenol A, bisphenol A ethylene oxide adduct, bisphenol A propylene oxide adduct, hydrogenated bisphenol A, hydrogenated bisphenol A ethylene oxide adduct, and hydrogenated bisphenol A propylene oxide adduct.

The toner of the present invention may include a release agent, examples of release agents including aliphatic hydrocarbon waxes such as low-molecular-weight polyethylene, low-molecular-weight polypropylene, microcrystalline wax, and paraffin wax; oxides of aliphatic hydrocarbon waxes such as polyethylene oxide wax; block copolymers of aliphatic hydrocarbon waxes; waxes including as the main component a fatty acid ester, such as carnauba wax, sasol wax, and montanic ester wax; products of partial esterification of fatty acids and polyhydric alcohols such as monoglyceride behenate and partially or completely deoxidized fatty acid esters such as deacidified carnauba wax; and methyl ester compounds having a hydroxyl group which are obtained by hydrogenation of vegetable oils and fats.

The content of the release agent is preferably at least 1.5 parts by mass and not more than 30 parts by mass per 100 parts by mass of the binder resin.

The toner of the present invention may include a charge control agent. Conventional well-known charge control agents can be used therein.

Examples of negative charge control agents include metal compounds of aromatic carboxylic acids such as salicylic acid, alkylsalicylic acids, dialkylsalicylic acids, naphthoic acid, and dicarboxylic acids; polymers or copolymers having a sulfonic acid group, a sulfonic acid salt group, or a sulfonic acid ester group; metal salt or metal complexes such as azo dyes and azo pigments; boron compounds, silicon compounds, and calixarene.

Further, examples of positive charge control agents include quaternary ammonium salts, macromolecular compounds having a quaternary ammonium salt in a side chain, guanidine compounds, nigrosine compound, and imidazole compounds.

Examples of suitable polymers or copolymers having a sulfonic acid salt group or a sulfonic acid ester group include homopolymers of vinyl monomers including a sulfonic acid group such as styrenesulfonic acid, 2-acrylamido-2-methylpropanesulfonic acid, 2-methacrylamido-2-methylpropanesulfonic acid, vinylsulfonic acid, and methacrylsulfonic acid, or copolymers of vinyl monomers and the vinyl monomers including a sulfonic acid group.

The content of the charge control agent is preferably at least 0.01 parts by mass and not more than 5.00 parts by mass per 100 parts by mass of the binder resin.

Next, methods for evaluating physical properties relating to the present invention will be explained.

<Method for Measuring Hydrophobic Parameters HPA and HPB>

The hydrophobic parameters HPA and HPB are measured in the following manner.

A total of 0.01 g of the resin A is placed in a 8 mL sample bottle and dissolved in 1.48 g (1.0 mL) of chloroform. The initial mass (W1) is then measured. A stirring element is inserted into the sample bottle and (a) 100 mg of heptane is dropwise added under stirring with a magnetic stirrer, and stirring is then continued for 20 s. (b) The presence of white turbidity is visually checked. Where white turbidity is not present, the operations (a) and (b) are repeated. The operations are stopped at a point in which white turbidity is confirmed (point of precipitation), and mass is measured (W2). The measurements are all conducted at 25° C. under a normal pressure (1 atm).

The HPA is calculated by the following formula. The specific gravity of heptane at 25° C. and under a 1 atm is 0.684, and that of chloroform is 1.48.

$$HP=\{(W2-W1)/0.684\}/\{[(W2-W1)/0.684]+1\}$$

The same measurements are repeated three times, and the average value thereof is taken as the HPA.

The HPB is measured in the same manner, except that the resin A in the abovementioned measurement method is replaced with the resin B.

<Method for Measuring Weight-Average Molecular Weight and Number-Average Molecular Weight of Resin A and Resin B>

The weight-average molecular weight (Mw) and number-average molecular weight (Mn) are measured in the following manner by using gel permeation chromatography (GPC).

Initially, the resin A or the resin B is dissolved in tetrahydrofuran (THF) at room temperature. Then, a sample solution is obtained by filtering the resulting solution with a solvent-resistant membrane filter "Sample Pretreatment Cartridge" with a pore diameter of 0.2 μm (manufactured by Tosoh Corporation). The sample solution is prepared such that the concentration of components soluble in THF is 0.8% by mass. The measurements are conducted under the following conditions by using the sample solution.

Device: high performance GPC system "HLC-8220GPC" (manufactured by Tosoh Corporation)

Column: 2 sets of LF-604 (manufactured by Showa Denko K.K.).

Eluent: THF

Flow rate: 0.6 mL/min

Oven temperature: 40° C.

Sample injection volume: 0.020 mL

A molecular weight calibration curve created using standard polystyrene resins (for example, trade name "TSK Standard polystyrene F-850, F-450, F-288, F-128, F-80, F-40, F-20, F-10, F-4, F-2, F-1, A-5000, A-2500, A-1000, A-500", by Tosoh Corporation) is used to calculate the molecular weight of the samples.

<Method for Measuring Weight-Average Particle Diameter (D4) of Toner Particles>

The weight-average particle diameter (D4) of toner particles is measured using a precision particle size distribution measuring device "Coulter Counter Multisizer 3 (registered trademark, manufactured by Beckman Coulter, Inc.). The measurements are conducted under the following conditions.

Effective number of measurement channels: 25,000 channels

Total number of control motors: 50,000

Aperture: 100 μm

Current: 1600 μA

Gain: 2

A Kd value is measured by the value obtained using "a standard particle 10.0 μm" (Beckman Coulter, Inc.).

The measurement data are analyzed with dedicated software provided with the device, and the weight-average particle diameter (D4) is calculated. The "average diameter" on the "Analysis/Volume Statistical Values (Arithmetic Average)" screen obtained at the time Graph/Volume % is set with the dedicated software is the weight–average particle diameter (D4).

<Method for Measuring Acid Value and pKa of Resin>

The acid value is the number of milligrams of potassium hydroxide needed to neutralize the acid contained in 1 g of the sample. The acid value in the present invention is measured according to JIS K 0070-1992. More specifically, the acid value is measured according to the following procedure.

Titration is performed using a 0.1 mol/L potassium hydroxide ethanol solution (manufactured by Kishida Chemical Co., Ltd.). The factor of the potassium hydroxide ethanol solution can be determined using a potentiometric titration device (potentiometric titration device AT-510, manufactured by Kyoto Electronics Manufacturing Co., Ltd.). A total of 100 mL of 0.1 mol/L hydrochloric acid is placed in a 250 mL tall beaker and titrated with the potassium hydroxide ethanol solution. The factor is determined from the amount of the potassium hydroxide ethanol solution required for neutralization. The 0.1 mol/L hydrochloric acid is produced according to JIS K 8001-1998.

Measurement conditions during acid value measurements are presented below.

Titration device: potentiometric titration device AT-510

Electrode: composite glass electrode of a double junction type (manufactured by Kyoto Electronics Manufacturing Co., Ltd.)

Control software for titration device: AT-WIN Titration analysis software: Tview The following titration parameters and control parameters are used during titration.

Titration parameters

Titration mode: blank titration

Titration system: full-volume titration

Maximum titration volume: 20 mL

Waiting time before the titration: 30 s

Titration direction: automatic

Control parameters

End point determination potential: 30 dE

End point determination potential value: 50 dE/dmL

End point detection and determination: not set

Control rate mode: standard

Gain: 1

Data collection potential: 4 mV

Data collection titration volume: 0.1 mL

Main Test

A total of 1.0 g of the measurement sample (resin A) is accurately weighed in a 250 mL tall beaker, 100.0 g of a mixed solution including 70.0 g of toluene and 30.0 g of ethanol is added, and the sample is dissolved over 1 h. Titration is performed with the potassium hydroxide ethanol solution by using the abovementioned potentiometric titration device.

Blank Test

The titration is performed by the same operations as described hereinabove, except that the sample is not used (that is, only 100.0 g of the mixed solution of toluene and ethanol (7:3) is used).

Calculation of Acid Value

The result obtained is substituted in the following formula to calculate the acid value:

$$A=[(C-B)\times f\times 5.611]/S.$$

(In the formula, A: acid value (mg KOH/g); B: amount added of the potassium hydroxide ethanol solution in the blank test (mL); C: amount added of the potassium hydroxide ethanol solution in the main test (mL); f: factor of potassium hydroxide ethanol solution; S: sample (g)).

Determination of pKa

A location with the largest inclination of pH changes from the titration curve obtained during acid value measurements is taken as the neutralization point. The pKa is determined in the following manner. A pH at half volume of the 0.1 mol/L potassium hydroxide ethanol solution which has been necessary up to the neutralization point is read from the titration curve, and the value of the pH which has been read is taken as the pKa. When the acid value is less than 0.5 and the neutralization point is difficult to determine, the pH of the titration start point is taken as the pKa.

EXAMPLES

The present invention will be explained hereinbelow in greater detail by examples thereof. The present invention is not intended to be limited to the below-described examples. In the examples, number of parts and % are all based on the mass standard, unless specifically stated otherwise.

<Synthesis Example of Compound C1>

A total of 78.6 g of 2,4-dihydroxybenzoic acid was dissolved in 400 mL of methanol, then 152.0 g of potassium carbonate was added, and the reaction liquid was heated to 60° C. A solution prepared by mixing and dissolving 87.9 g of 4-(chloromethyl)styrene in 100 mL of methanol was dropwise added to the reaction liquid, and a reaction was conducted for 2.5 h at 60° C. The resulting reaction liquid was cooled and then filtered and washed with methanol.

The resulting precipitate was dispersed with hydrochloric acid in 1 L of water at pH=1. Subsequent filtration, washing with water, and drying at 80° C. yielded 55.7 g of Compound C1 represented by formula (6) below.

(Compound C1)

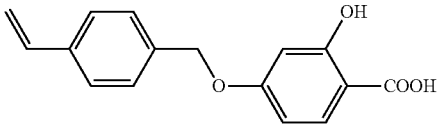

(6)

<Synthesis Example of Compound C2>

A total of 18 g of 2,5-dihydroxy-3-methoxybenzoic acid was dissolved in 150 mL of methanol, then 36.9 g of potassium carbonate was added, and the reaction liquid was heated to 65° C. A mixture of 18.7 g of 4-(chloromethyl) styrene and 100 mL of methanol was dropwise added to the reaction liquid, and a reaction was conducted for 3 h at 65° C. The reaction liquid was cooled and filtered, and the filtrate was concentrated to obtain a crude product. The crude product was dispersed in 1.5 L of water with pH=2 and extracted by adding ethyl acetate. Then, washing with water, drying with magnesium sulfate, and distillation of ethyl acetate under a reduced pressure were performed to obtain a precipitate. The precipitate was washed with hexane and purified by recrystallization with toluene and ethyl acetate. As a result, 20.1 g of Compound C2 represented by formula (7) below was obtained.

(Compound C2)

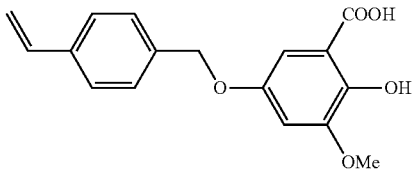

(7)

<Synthesis Example of Compound C3>

(Step 1)

A total of 100 g of 2,5-dihydroxybenzoic acid and 1441 g of 80% sulfuric acid were heated to 50° C. and mixed. A total of 144 g of tert-butyl alcohol was added to the dispersion and stirring was performed for 30 min at 50° C. Then, the operation of adding 144 g of tert-butyl alcohol to the dispersion and stirring for 30 min was repeated three times. The reaction liquid was cooled to room temperature and slowly poured into 1 kg of ice water. The precipitate was washed with water than then washed with hexane. The precipitate was dissolved in 200 mL of methanol and reprecipitated in 3.6 L of water. Drying at 80° C. after filtration yielded 74.9 g of a salicylic acid intermediate repressed by formula (8) below.

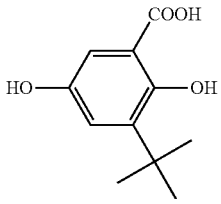

(8)

(Step 2)

Compound C3 represented by formula (9) below was obtained in the same manner as in the synthesis example of Compound C2, except that 2,5-dihydroxy-3-methoxybenzoic acid was changed to 25.0 g of salicylic acid intermediate represented by formula (8) above.

(9)

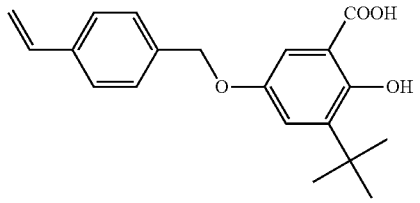

(Compound C3)

<Synthesis Example of Compound C4>

A salicylic acid intermediate was obtained by the same method as in the synthesis of Compound C3 (step 1) except that 144 g of tert-butyl alcohol was changed to 253 g of 2-octanol. Compound C4 represented by formula (10) below was obtained by the same method as in the synthesis example of Compound C3 (step 2), except that 32 g of the salicylic acid intermediate obtained herein was used.

(10)

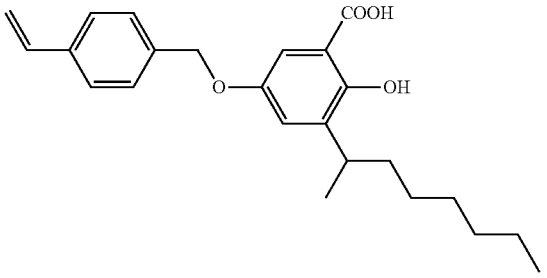

(Compound C4)

<Synthesis Example of Compound C5>

A total of 53.9 g of 2,3-dihydroxybenzoic acid was dissolved in 280 mL of methanol, 106 g of $K_2CO_3$ was added thereto, and stirring was performed for 30 min at 65° C. A total of 61.7 g of 4-chloromethylstyrene was then dropwise added over 1 h. The reaction conducted for 3 h under refluxing was followed by natural cooling to room temperature. The precipitate was filtered and then washed with methanol. Methanol present in the filtrate was removed under a reduced pressure to yield a brown semi-solid body. The brown semi-solid body was dispersed in ethyl acetate and water, and pH was adjusted to 1 with hydrochloric acid. The ethyl acetate layer was washed with saturated saline and dried with magnesium sulfate. The solvent was then removed under a reduced pressure to yield 124.3 g of a light yellow solid body. The light yellow solid body was recrystallized with toluene to obtain 54.5 g of Compound C5 represented by formula (11) below.

(11)

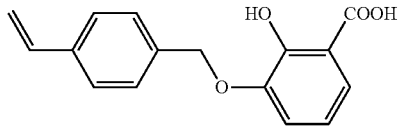

(Compound C5)

<Synthesis Example of Compound C6>

Compound C6 represented by formula (12) below was produced by using the method described in Japanese Patent Application Publication No. S63-270060.

(12)

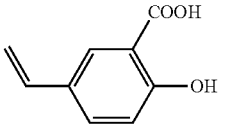

(Compound C6)

(Compound C7)

4-Vinylbenzyl amine was used as Compound C7.

<Synthesis Example of Resin A1>

A total of 60.0 parts of toluene was loaded into a reaction vessel equipped with a stirrer, a condenser, a thermometer, and a nitrogen introducing tube, and refluxing was performed under a nitrogen gas flow.

Then, a monomer mixed liquid was prepared by mixing the following starting materials and solvents.

| | |
|---|---|
| Styrene | 100.0 parts |
| Compound C1 | 8.6 parts |
| Stearyl methacrylate | 25.3 parts |
| Toluene | 60.0 parts |

A total of 10.0 parts of t-butylperoxy isopropyl monocarbonate (75% diluted product of a hydrocarbon solvent) was further mixed as a polymerization initiator with the monomer mixed liquid and dropwise added over 30 min to the reaction vessel. The reaction liquid was stirred at 125° C. and cooled to room temperature at a point of time at which the desired molecular weight was obtained. The resulting polymer-containing composition was dropwise added to a mixed solution of 1400 parts of methanol and 10 parts of acetone over 10 min under stirring, and the resin composition was precipitated and crystallized. The resulting resin composition was filtered and rinsed twice with 200 parts of methanol. The resulting resin powder was dried for 10 h at 60° C. under a reduced pressure to yield a resin A1.

The resulting resin A1 had a hydrophobic parameter HPA of 0.78, a weight-average molecular weight of 32,000, an acid value of 14.3 mg KOH/g, and a pKa of 7.3.

<Synthesis Example of Resins A2-A19>

Resins A2 to A19 were synthesized by the same method as in the synthesis example of resin A1, except that the types and amounts of the monomers were appropriately changed according to the compositions shown in Table 1, and the molecular weight was controlled by appropriately changing the polymerization temperature and the amount of the initiator as shown in Table 1. The analysis results of the synthesized resins A are shown in Table 2. As for n in formula (5) above, n=3 (butyl methacrylate), n=17 (stearyl methacrylate), and n=21 (behenyl methacrylate).

TABLE 1

| | Monomer composition ratio (mol %) | | | | | | | |
|---|---|---|---|---|---|---|---|---|
| | Compound | | Polymerization conditions | | | | | |
| | Type | Composition ratio | Amount of initiator (parts) | Polymerization temperature | Styrene | Stearyl methacrylate | Butyl methacrylate | Behenyl methacrylate |
| Resin A1 | C 1 | 3.0 | 10.0 | 125° C. | 90.0 | 7.0 | — | — |
| Resin A2 | C 1 | 3.0 | 10.0 | 125° C. | 87.0 | — | 10.0 | — |
| Resin A3 | C 1 | 3.0 | 10.0 | 125° C. | 91.0 | — | — | 6.0 |
| Resin A4 | C 1 | 3.0 | 30.0 | 90° C. | 90.0 | 7.0 | — | — |
| Resin A5 | C 1 | 3.0 | 30.0 | 100° C. | 90.0 | 7.0 | — | — |
| Resin A6 | C 1 | 3.0 | 7.0 | 125° C. | 90.0 | 7.0 | — | — |
| Resin A7 | C 1 | 3.0 | 5.0 | 125° C. | 90.0 | 7.0 | — | — |
| Resin A8 | C 1 | 0.5 | 10.0 | 125° C. | 92.5 | 7.0 | — | — |
| Resin A9 | C 1 | 1.0 | 10.0 | 125° C. | 92.0 | 7.0 | — | — |
| Resin A10 | C 1 | 2.0 | 10.0 | 125° C. | 91.0 | 7.0 | — | — |
| Resin A11 | C 1 | 5.0 | 10.0 | 125° C. | 85.0 | 10.0 | — | — |
| Resin A12 | C 1 | 7.0 | 10.0 | 125° C. | 83.0 | 10.0 | — | — |
| Resin A13 | C 2 | 3.0 | 10.0 | 125° C. | 90.0 | 7.0 | — | — |
| Resin A14 | C 3 | 3.0 | 10.0 | 125° C. | 90.0 | 7.0 | — | — |
| Resin A15 | C 3 | 3.0 | 10.0 | 125° C. | 87.0 | 10.0 | — | — |
| Resin A16 | C 3 | 3.0 | 10.0 | 125° C. | 82.0 | 15.0 | — | — |
| Resin A17 | C 4 | 3.0 | 10.0 | 125° C. | 90.0 | 7.0 | — | — |
| Resin A18 | C 5 | 3.0 | 10.0 | 125° C. | 90.0 | 7.0 | — | — |
| Resin A19 | C 6 | 3.0 | 10.0 | 125° C. | 90.0 | 7.0 | — | — |
| Resin a1 | C 1 | 5.0 | 10.0 | 125° C. | 95.0 | — | — | — |
| Resin a2 | C 6 | 3.0 | 30.0 | 90° C. | 90.0 | 7.0 | — | — |
| Resin a3 | C 7 | 3.0 | 30.0 | 90° C. | 90.0 | 7.0 | — | — |

TABLE 2

| | Molecular weight | | pKa | Acid value | |
|---|---|---|---|---|---|
| | Mn | Mw | (mgKOH/g) | (mgKOH/g) | HPA |
| Resin A1 | 14000 | 32000 | 7.3 | 14.3 | 0.78 |
| Resin A2 | 12000 | 30000 | 7.2 | 13.8 | 0.66 |
| Resin A3 | 16000 | 31000 | 7.3 | 14.2 | 0.80 |
| Resin A4 | 3000 | 8000 | 6.9 | 14.6 | 0.77 |
| Resin A5 | 4000 | 12000 | 7.1 | 14.2 | 0.78 |
| Resin A6 | 21000 | 51000 | 7.5 | 14.4 | 0.77 |
| Resin A7 | 31000 | 74000 | 7.5 | 14.3 | 0.78 |
| Resin A8 | 14000 | 30000 | 7.1 | 2.5 | 0.90 |
| Resin A9 | 12000 | 30000 | 7.1 | 5.1 | 0.88 |
| Resin A10 | 14000 | 31000 | 7.4 | 9.6 | 0.81 |
| Resin A11 | 13000 | 31000 | 7.4 | 23.6 | 0.74 |
| Resin A12 | 12000 | 31000 | 7.3 | 35.3 | 0.65 |
| Resin A13 | 12000 | 29000 | 8.1 | 13.1 | 0.78 |
| Resin A14 | 13000 | 31000 | 7.3 | 13.6 | 0.81 |
| Resin A15 | 120000 | 29000 | 7.4 | 13.2 | 0.88 |
| Resin A16 | 10000 | 28000 | 7.4 | 12.1 | 0.94 |
| Resin A17 | 11000 | 28000 | 7.3 | 12.9 | 0.82 |
| Resin A18 | 12000 | 32000 | 7.6 | 14 | 0.78 |
| Resin A19 | 12000 | 28000 | 6.6 | 14.7 | 0.76 |
| Resin a1 | 13000 | 29000 | 7.3 | 24.5 | 0.43 |
| Resin a2 | 4000 | 9000 | 5.8 | 14.9 | 0.78 |
| Resin a3 | 3000 | 8000 | 9.8 | 0 | 0.76 |

<Production Example of Toner 1>

| | |
|---|---|
| Styrene | 216.0 parts |
| Pigment Blue 15:3 (Cyanine Blue 4920; manufactured by Dainichiseika Color & Chemicals Mfg. Co., Ltd.) | 48.0 parts |
| Resin A1 | 4.8 parts |

The abovementioned materials were introduced in an attriter (manufactured by Nippon Coke & Engineering Co., Ltd.), stirring was conducted for 180 min at 250 rpm and 25° C. by using zirconia beads (180 parts) with a radius of 2.5 mm to yield a master batch dispersion (MB) 1.

| | |
|---|---|
| Master batch dispersion 1 | 201.6 parts |
| Styrene monomer | 115.4 parts |
| n-Butyl acrylate monomer | 92.5 parts |
| Hydrocarbon wax (HNP-9, manufactured by Nippon Seiro Co., Ltd.) | 27.0 parts |
| Polyester resin 1 | 13.5 parts |

(a polycondensate of terephthalic acid: isophthalic acid: propylene oxide-modified bisphenol A (2 mol adduct): ethylene oxide-modified bisphenol A (2 mol adduct)=30:20:30:20; acid value 7.5, Tg=74° C., Mw=12,000, Mn=4000)

The abovementioned materials were mixed, heated to 65° C., homogeneously dissolved and dispersed over 60 min at 3500 rpm by using a TK homomixer (manufactured by Tokushu Kika Kogyo Co., Ltd.) to yield a toner composition solution.

Meanwhile, 480.0 parts of 0.1 mol/L-$Na_3PO_4$ aqueous solution was loaded into 1000.0 parts of ion-exchanged water in 2 L four-neck flask equipped with a TK homomixer, the TK homomixer was adjusted to 10,000 rpm, and heating was performed to 60° C. Then, 71.9 parts of 1.0 mol/L-$CaCl_2$ aqueous solution and 3.9 parts of 10% hydrochloric acid were gradually added to yield an aqueous medium including a calcium phosphate compound.

Next, 29.6 parts of a 75% toluene solution of 1,1,3,3-tetramethylbutylperoxy-2-ethyl hexanoate was dissolved as a polymerization initiator in the toner composition solution, followed by thorough mixing. The resulting solution was then loaded into the aqueous medium. The resulting system was stirred for 10 min at 10,000 rpm with the TK homomixer at 65° C. under a $N_2$ atmosphere to granulate the polymerizable monomer composition. The temperature was then raised to 75° C. under stirring with a paddle stirring blade and polymerization was performed for 5 h. The temperature was then raised to 85° C. at a temperature rise rate of 1° C./min, the reaction was conducted for 1 h, and the polymerization reaction was ended. Next, the residual monomers of the toner particle were distilled off under a reduced pressure, and the aqueous medium was cooled to yield a dispersion of toner particles. Hydrochloric acid was added to the dispersion of toner particles to adjust pH to 1.4, and the calcium phosphate salt was dissolved by stirring for 1 h. The resulting system was subjected to solid-liquid separation under a pressure of 0.4 MPa in a pressure filter to yield a toner cake. Next, the pressure filter was fully filled up with ion-exchanged water and washing was performed under a pressure of 0.4 MPa. Toner particles were obtained by repeating the washing operation three times and then drying.

A total of 1.5 part (number-average primary particle diameter: 10 nm) of a fine hydrophobic silica powder which was surface treated with hexamethyldisilazane was added to 100 parts of the toner particles, and toner 1 was obtained by mixing for 300 s with a FM mixer (manufactured by Nippon Coke & Engineering Co., Ltd.). The above-described production method will be referred to as production method A.

<Production of Toners 2 to 31 and Comparative Toners 1 to 9>

Toners 2 to 31 and Comparative Toners 1 to 9 were produced by the same production method A as in the production example of the toner 1, except that the types and amounts of the starting materials used were appropriately changed according to the compositions shown in Table 3.

The styrene acrylic resin 1 in Table 3 is a copolymer of styrene, n-butyl acrylate, methacrylic acid, and 2-hydroxyethyl methacrylate, this resin has a Mn of 7000, a Mw of 21,000, a glass transition temperature (Tg) of 53.0° C., an acid value of 10.3 mg KOH/g, a hydroxyl value of 3.8 mg KOH/g, and a hydrophobic parameter of 0.67.

TABLE 3

| | MB | | | | | Toner particle composition | | | | | | |
|---|---|---|---|---|---|---|---|---|---|---|---|---|
| | | | | | | | Resin B | | Other resins | Other resins | | |
| Toner No. | Styrene (parts) | Pigment | (parts) | Resin A | (parts) | MB (parts) | Styrene (parts) | Butyl acrylate (parts) | (polyester resin 1) (parts) | (styrene acrylic resin 1) (parts) | WAX (HNP-9) (parts) | Initiator (parts) |
| 1 | 216.0 | PB15:3 | 48.0 | A1 | 4.8 | 201.6 | 115.4 | 92.5 | 13.5 | — | 27.0 | 29.6 |
| 2 | 216.0 | PB15:3 | 48.0 | A1 | 4.8 | 201.6 | 81.7 | 81.2 | 13.5 | 45.0 | 27.0 | 26.0 |
| 3 | 216.0 | PB15:3 | 48.0 | A1 | 4.8 | 201.6 | 31.1 | 64.4 | 13.5 | 112.5 | 27.0 | 20.6 |
| 4 | 216.0 | PB15:3 | 48.0 | A2 | 4.8 | 201.6 | 81.7 | 81.2 | 13.5 | 45.0 | 27.0 | 26.0 |
| 5 | 216.0 | PB15:3 | 48.0 | A3 | 4.8 | 201.6 | 81.7 | 81.2 | 13.5 | 45.0 | 27.0 | 26.0 |
| 6 | 216.0 | PB15:3 | 48.0 | A 4 | 4.8 | 201.6 | 81.7 | 81.2 | 13.5 | 45.0 | 27.0 | 26.0 |
| 7 | 216.0 | PB15:3 | 48.0 | A 5 | 4.8 | 201.6 | 81.7 | 81.2 | 13.5 | 45.0 | 27.0 | 26.0 |
| 8 | 216.0 | PB15:3 | 48.0 | A 6 | 4.8 | 201.6 | 81.7 | 81.2 | 13.5 | 45.0 | 27.0 | 26.0 |
| 9 | 216.0 | PB15:3 | 48.0 | A 7 | 4.8 | 201.6 | 81.7 | 81.2 | 13.5 | 45.0 | 27.0 | 26.0 |
| 10 | 216.0 | PB15:3 | 48.0 | A1 | 1.2 | 198.9 | 117.5 | 93.2 | 13.5 | — | 27.0 | 29.8 |
| 11 | 216.0 | PB15:3 | 48.0 | A1 | 1.5 | 199.1 | 117.3 | 93.1 | 13.5 | — | 27.0 | 29.8 |
| 12 | 216.0 | PB15:3 | 48.0 | A1 | 2.4 | 199.8 | 116.8 | 92.9 | 13.5 | — | 27.0 | 29.7 |
| 13 | 216.0 | PB15:3 | 48.0 | A1 | 9.6 | 205.2 | 112.7 | 91.6 | 13.5 | — | 27.0 | 29.3 |
| 14 | 216.0 | PB15:3 | 48.0 | A1 | 14.4 | 208.8 | 110.0 | 90.7 | 13.5 | — | 27.0 | 29.0 |
| 15 | 216.0 | PB15:3 | 48.0 | A1 | 24.0 | 216.0 | 104.6 | 88.9 | 13.5 | — | 27.0 | 28.4 |
| 16 | 216.0 | PB15:3 | 48.0 | A 8 | 14.4 | 208.8 | 110.0 | 90.7 | 13.5 | — | 27.0 | 29.0 |
| 17 | 216.0 | PB15:3 | 48.0 | A 9 | 14.4 | 208.8 | 110.0 | 90.7 | 13.5 | — | 27.0 | 29.0 |
| 18 | 216.0 | PB15:3 | 48.0 | A 1 0 | 9.6 | 205.2 | 112.7 | 91.6 | 13.5 | — | 27.0 | 29.3 |
| 19 | 216.0 | PB15:3 | 48.0 | A 1 1 | 4.8 | 201.6 | 115.4 | 92.5 | 13.5 | — | 27.0 | 29.6 |
| 20 | 216.0 | PB15:3 | 48.0 | A 1 2 | 4.8 | 201.6 | 115.4 | 92.5 | 13.5 | — | 27.0 | 29.6 |
| 21 | 216.0 | PB15:3 | 48.0 | A 1 4 | 4.8 | 201.6 | 115.4 | 92.5 | 13.5 | — | 27.0 | 29.6 |
| 22 | 216.0 | PB15:3 | 48.0 | A 1 5 | 4.8 | 201.6 | 115.4 | 92.5 | 13.5 | — | 27.0 | 29.6 |
| 23 | 216.0 | PB15:3 | 48.0 | A 1 6 | 4.8 | 201.6 | 115.4 | 92.5 | 13.5 | — | 27.0 | 29.6 |
| 24 | 216.0 | PB15:3 | 48.0 | A 1 7 | 4.8 | 201.6 | 115.4 | 92.5 | 13.5 | — | 27.0 | 29.6 |
| 25 | 216.0 | PB15:3 | 48.0 | A 1 8 | 4.8 | 201.6 | 115.4 | 92.5 | 13.5 | — | 27.0 | 29.6 |
| 26 | 216.0 | PB15:3 | 48.0 | A 1 9 | 4.8 | 201.6 | 115.4 | 92.5 | 13.5 | — | 27.0 | 29.6 |
| 27 | 216.0 | PB15:3 | 48.0 | A 1 3 | 4.8 | 201.6 | 115.4 | 92.5 | 13.5 | — | 27.0 | 29.6 |
| 28 | 216.0 | CB | 48.0 | A1 | 4.8 | 201.6 | 115.4 | 92.5 | 13.5 | — | 27.0 | 29.6 |
| 29 | 216.0 | PR122 | 48.0 | A1 | 4.8 | 201.6 | 115.4 | 92.5 | 13.5 | — | 27.0 | 29.6 |
| 30 | 216.0 | PR122/PR19 | 48.0 | A1 | 4.8 | 201.6 | 115.4 | 92.5 | 13.5 | — | 27.0 | 29.6 |
| 31 | 216.0 | PR269 | 48.0 | A1 | 4.8 | 201.6 | 115.4 | 92.5 | 13.5 | — | 27.0 | 29.6 |

TABLE 3-continued

| | MB | | | | | Toner particle composition | | | | | | |
|---|---|---|---|---|---|---|---|---|---|---|---|---|
| | | | | | | | Resin B | | Other resins | Other resins | | |
| Toner No. | Styrene (parts) | Pigment | (parts) | Resin A | (parts) | MB (parts) | Styrene (parts) | Butyl acrylate (parts) | (polyester resin 1) (parts) | (styrene acrylic resin 1) (parts) | WAX (HNP-9) (parts) | Initiator (parts) |
| Comparative 1 | 216.0 | PB15:3 | 48.0 | — | — | 198.0 | 118.1 | 93.4 | 13.5 | — | 27.0 | 29.9 |
| Comparative 2 | 216.0 | PB15:3 | 48.0 | a 1 | 4.8 | 201.6 | 115.4 | 92.5 | 13.5 | — | 27.0 | 29.6 |
| Comparative 3 | 216.0 | PB15:3 | 48.0 | a 2 | 4.8 | 201.6 | 115.4 | 92.5 | 13.5 | — | 27.0 | 29.6 |
| Comparative 4 | 216.0 | PB15:3 | 48.0 | a 3 | 4.8 | 201.6 | 115.4 | 92.5 | 13.5 | — | 27.0 | 29.6 |
| Comparative 5 | 216.0 | CB | 48.0 | — | — | 198.0 | 118.1 | 93.4 | 13.5 | — | 27.0 | 29.9 |
| Comparative 6 | 216.0 | CB | 48.0 | a 1 | 4.8 | 201.6 | 115.4 | 92.5 | 13.5 | — | 27.0 | 29.6 |
| Comparative 7 | 216.0 | PR122 | 48.0 | — | — | 198.0 | 118.1 | 93.4 | 13.5 | — | 27.0 | 29.9 |
| Comparative 8 | 216.0 | PR122/PR19 | 48.0 | — | — | 198.0 | 118.1 | 93.4 | 13.5 | — | 27.0 | 29.9 |
| Comparative 9 | 216.0 | PR269 | 48.0 | — | — | 198.0 | 118.1 | 93.4 | 13.5 | — | 27.0 | 29.9 |

Reference symbols in the table have the following meaning: PB15:3 (Pigment Blue 15:3), CB (carbon black), PR122 (Pigment Red 122), PR19 (Pigment Red 19), PR269 (Pigment Red 269), MB (master batch dispersion).

<Production Example of Toner 32)

| | |
|---|---|
| Methyl ethyl ketone | 192 parts |
| Pigment Blue 15:3 | 48 parts |
| Resin A14 | 4.8 parts |

The abovementioned materials were introduced in an attriter (manufactured by Nippon Coke & Engineering Co., Ltd.), and stirring was conducted for 180 min at 250 rpm and 25° C. by using zirconia beads (180 parts) with a radius of 2.5 mm to yield a master batch dispersion 1B.

| | |
|---|---|
| Methyl ethyl ketone | 34.2 parts |
| Master batch dispersion 1B | 128.5 parts |
| Polyester resin 2 (a polycondensate of terephthalic acid:propylene oxide-modified bisphenol A (2 mol adduct):hexane diol = 50:30:20; acid value 9.5, Tg = 60° C., Mw = 29,000, Mn = 12,000, hydrophobic parameter = 0.81) | 177.0 parts |
| Polyester resin 3 (a polycondensate of terephthalic acid:propylene oxide-modified bisphenol A (2 mol adduct):ethylene oxide-modified bisphenol A (2 mol adduct):trimellitic anhydride=50:30:19.5:0.5; acid value 12.5, Tg=74° C., Mw=21,000, Mn=9000, hydrophobic parameter=0.49) | 94.5 parts |
| Hydrocarbon wax (HNP-9, manufactured by Nippon Seiro Co., Ltd.) | 15.8 parts |

The abovementioned materials were mixed, heated to 75° C., homogeneously dissolved and dispersed over 60 min at 5000 rpm by using a TK homomixer to yield a toner composition solution.

Meanwhile, 480.0 parts of 0.1 mol/L-$Na_3PO_4$ aqueous solution was loaded into 1000.0 parts of ion-exchanged water in 2 L four-neck flask equipped with a TK homomixer, the TK homomixer was adjusted to 10,000 rpm, and heating was performed to 60° C. Then, 71.9 parts of 1.0 mol/L-$CaCl_2$ aqueous solution and 3.9 parts of 10% hydrochloric acid were gradually added to yield an aqueous medium including a calcium phosphate compound.

The toner composition solution was loaded into the aqueous medium. The toner composition solution was then granulated by stirring for 30 min at 13,000 rpm with a TK homomixer at 75° C. The temperature was then raised to 85° C. under stirring with a paddle stirring blade and distillation was performed for 5 h under a normal pressure. Next, the residual solvent was distilled off under a reduced pressure, and the aqueous medium was cooled to yield a dispersion of toner particles.

Hydrochloric acid was added to the dispersion of toner particles to adjust pH to 1.4, and the calcium phosphate salt was dissolved by stirring for 1 h. The resulting system was subjected to solid-liquid separation under a pressure of 0.4 MPa in a pressure filter to yield a toner cake. Next, the pressure filter was fully filled up with ion-exchanged water and washing was performed under a pressure of 0.4 MPa. Toner particles were obtained by repeating the washing operation three times and then drying.

A total of 1.5 part (number-average primary particle diameter: 10 nm) of a fine hydrophobic silica powder which was surface treated with hexamethyldisilazane was added to 100 parts of the toner particles, and toner 32 was obtained by mixing for 300 s with the FM mixer. The above-described production method will be referred to as production method B.

<Production Method of Toners 33 to 37>

Toners 33 to 37 were produced by the same production method B as in the production example of toner 32, except that the types and amounts of the starting materials used were appropriately changed according to the compositions shown in Table 4.

In Table 4, a polyester resin 4 is a polycondensate of terephthalic acid: propylene oxide-modified bisphenol A (2 mol adduct):hexane diol=50:15:35; acid value 8.9, Tg=47° C., Mw=28,000, Mn=11,000, hydrophobic parameter=0.91. In Table 4, a polyester resin 5 is a polycondensate of terephthalic acid:ethylene oxide-modified bisphenol A (2 mol adduct):hexane diol=50: 40:10; acid value 8.5, Tg=65° C., Mw=21,000, Mn=9000, hydrophobic parameter=0.76.

TABLE 4

| | MB | | | | | Toner particle composition | | | | | | | |
|---|---|---|---|---|---|---|---|---|---|---|---|---|---|
| | MEK (parts) | Pigment | (parts) | Resin A | (parts) | MEK (parts) | MB (parts) | Resin B | (parts) | Other resins | (parts) | WAX | (parts) |
| Toner 32 | 192.0 | PB15:3 | 48.0 | A 1 4 | 4.8 | 34.2 | 128.5 | Polyester resin 2 | 177.0 | Polyester resin 3 | 94.5 | HNP-9 | 15.8 |
| Toner 33 | 192.0 | PB15:3 | 48.0 | A 1 5 | 4.8 | 34.2 | 128.5 | Polyester resin 2 | 177.0 | Polyester resin 3 | 94.5 | HNP-9 | 15.8 |
| Toner 34 | 192.0 | PB15:3 | 48.0 | A 1 1 | 4.8 | 34.2 | 128.5 | Polyester resin 4 | 177.0 | Polyester resin 3 | 94.5 | HNP-9 | 15.8 |
| Toner 35 | 192.0 | PB15:3 | 48.0 | A 1 2 | 4.8 | 34.2 | 128.5 | Polyester resin 4 | 177.0 | Polyester resin 3 | 94.5 | HNP-9 | 15.8 |
| Toner 36 | 192.0 | PB15:3 | 48.0 | A 1 5 | 4.8 | 34.2 | 128.5 | Polyester resin 5 | 177.0 | Polyester resin 3 | 94.5 | HNP-9 | 15.8 |
| Toner 37 | 192.0 | CB | 48.0 | A 1 | 4.8 | 34.2 | 128.5 | Polyester resin 2 | 177.0 | Polyester resin 3 | 94.5 | HNP-9 | 15.8 |

<Production Example of Toner 38>

| | |
|---|---|
| Methyl ethyl ketone | 160 parts |
| Pigment Blue 15:3 (Cyanine Blue 4920; manufactured by Dainichiseika Color & Chemicals Mfg. Co., Ltd.) | 40 parts |
| Resin A14 | 6.0 parts |

The abovementioned materials were introduced in an attriter and stirred for 180 min at 250 rpm and 25° C. by using zirconia beads (180 parts) with a radius of 2.5 mm to yield a master batch dispersion 1C.

A total of 227.2 parts of a polyester resin 2 was loaded in a twin-screw kneader (PCM-30, manufactured by Ikegai Corp.) which was set to a temperature of 120° C., then 164.8 parts of the master batch dispersion 1C was loaded in three batches, and the solvent was removed by kneading. Then, 120.0 parts of the polyester resin 3 and 16.0 parts of hydrocarbon wax (HNP-9, manufactured by Nippon Seiro Co., Ltd.) were loaded and kneading was performed.

The resulting kneaded product was coarsely pulverized to 1 mm or less with a hammer mill to yield a coarsely pulverized material. The resulting coarsely pulverized material was finely pulverized in a mechanical pulverizer (T-250, manufactured by Turbo Kogyo Co., Ltd.). Toner particles 1 were then obtained by classification using a rotary classifier (200TSP, manufactured by Hosokawa Micron Corporation). As for the operation conditions of the rotary classifier (200TSP, manufactured by Hosokawa Micron Corporation), the classification was performed at a classification rotor revolution speed of 50.0 $s^{-1}$. The resulting toner particles 38 had a weight-average particle diameter (D4) of 6.0 μm.

A total of 1.5 part (number-average primary particle diameter: 10 nm) of a fine hydrophobic silica powder which was surface treated with hexamethyldisilazane was added to 100 parts of the toner particles, and toner 38 was obtained by mixing for 300 s with a FM mixer (manufactured by Nippon Coke & Engineering Co., Ltd.). The above-described production method will be referred to as production method C.

<Production Example of Toners 39-43>

Toners 39 to 43 were produced by the same production method C as in the production example of toner 38, except that the types and amounts of the starting materials used were appropriately changed according to the compositions shown in Table 5.

TABLE 5

| | MB | | | | | Toner particle composition | | | | | | |
|---|---|---|---|---|---|---|---|---|---|---|---|---|
| | MEK (parts) | Pigment | Parts | Resin A | Parts | MB (Parts) | Resin B | Parts | Other resins | Parts | WAX | Parts |
| Toner 38 | 160.0 | PB15:3 | 40.0 | A 1 4 | 6.0 | 164.8 | Polyester resin 2 | 227.2 | Polyester resin 3 | 120.0 | HNP-9 | 16.0 |
| Toner 39 | 160.0 | C B | 40.0 | A 1 | 6.0 | 164.8 | Polyester resin 2 | 227.2 | Polyester resin 3 | 120.0 | HNP-9 | 16.0 |
| Toner 40 | 160.0 | C B | 40.0 | A 1 | 10.0 | 168.0 | Polyester resin 2 | 344.0 | — | — | HNP-9 | 16.0 |
| Toner 41 | 160.0 | C B | 40.0 | — | — | 160.0 | Polyester resin 2 | 344.0 | Resin A 1 | 8.0 | HNP-9 | 16.0 |
| Toner 42 | 160.0 | C B | 40.0 | — | — | 160.0 | Polyester resin 2 | 256.0 | Resin A 1 | 96.0 | HNP-9 | 16.0 |
| Toner 43 | 160.0 | C B | 40.0 | — | — | 160.0 | Polyester resin 2 | 192.0 | Resin A 1 | 160.0 | HNP-9 | 16.0 |

The results of analysis of the produced cyan toner are shown in Table 6, the results of analysis of the black toner are shown in Table 7, and the results of analysis of the magenta toner are shown in Table 8. In the tables, the HPB of the St/Ba polymer indicates the results measured using the polymer obtained by separate polymerization at a composition ratio of styrene and n-butyl acrylate in the toner production example.

TABLE 6

| Cyan | Toner production method | Resin A No. | Resin A pKa | Resin A HPA | Resin A Amount added | Resin B resin | Resin B HPB | Resin B/ total amount of resin | HPB − HPA |
|---|---|---|---|---|---|---|---|---|---|
| Toner 1 | A | A1 | 7.3 | 0.78 | 10.0 | St/BA Polymer | 0.88 | 95.6 | 0.10 |
| Toner 2 | A | A1 | 7.3 | 0.78 | 10.0 | St/BA Polymer | 0.88 | 84.0 | 0.10 |
| Toner 3 | A | A1 | 7.3 | 0.78 | 10.0 | St/BA Polymer | 0.88 | 66.5 | 0.10 |
| Toner 4 | A | A2 | 7.2 | 0.66 | 10.0 | St/BA Polymer | 0.88 | 84.0 | 0.22 |
| Toner 5 | A | A3 | 7.3 | 0.8 | 10.0 | St/BA Polymer | 0.88 | 84.0 | 0.08 |
| Toner 6 | A | A 4 | 6.9 | 0.77 | 10.0 | St/BA Polymer | 0.88 | 84.0 | 0.11 |
| Toner 7 | A | A 5 | 7.1 | 0.78 | 10.0 | St/BA Polymer | 0.88 | 84.0 | 0.10 |
| Toner 8 | A | A 6 | 7.5 | 0.77 | 10.0 | St/BA Polymer | 0.88 | 96.3 | 0.11 |
| Toner 9 | A | A 7 | 7.5 | 0.78 | 10.0 | St/BA Polymer | 0.88 | 96.2 | 0.10 |
| Toner 10 | A | A1 | 7.3 | 0.78 | 2.5 | St/BA Polymer | 0.88 | 96.0 | 0.10 |
| Toner 11 | A | A1 | 7.3 | 0.78 | 3.0 | St/BA Polymer | 0.88 | 94.7 | 0.10 |
| Toner 12 | A | A1 | 7.3 | 0.78 | 5.0 | St/BA Polymer | 0.88 | 93.7 | 0.10 |
| Toner 13 | A | A1 | 7.3 | 0.78 | 20.0 | St/BA Polymer | 0.88 | 91.9 | 0.10 |
| Toner 14 | A | A1 | 7.3 | 0.78 | 30.0 | St/BA Polymer | 0.88 | 95.6 | 0.10 |
| Toner 15 | A | A1 | 7.3 | 0.78 | 50.0 | St/BA Polymer | 0.88 | 95.6 | 0.10 |
| Toner 16 | A | A 8 | 7.1 | 0.9 | 30.0 | St/BA Polymer | 0.88 | 95.6 | −0.02 |
| Toner 17 | A | A 9 | 7.1 | 0.88 | 30.0 | St/BA Polymer | 0.88 | 95.6 | 0.00 |
| Toner 18 | A | A 1 0 | 7.4 | 0.81 | 20.0 | St/BA Polymer | 0.88 | 95.6 | 0.07 |
| Toner 19 | A | A 1 1 | 7.4 | 0.74 | 10.0 | St/BA Polymer | 0.88 | 95.6 | 0.14 |
| Toner 20 | A | A 1 2 | 7.3 | 0.65 | 10.0 | St/BA Polymer | 0.88 | 95.6 | 0.23 |
| Toner 21 | A | A 1 4 | 7.3 | 0.81 | 10.0 | St/BA Polymer | 0.88 | 95.6 | 0.07 |
| Toner 22 | A | A 1 5 | 7.4 | 0.88 | 10.0 | St/BA Polymer | 0.88 | 95.6 | 0.00 |
| Toner 23 | A | A 1 6 | 7.4 | 0.94 | 10.0 | St/BA Polymer | 0.88 | 95.6 | −0.06 |
| Toner 24 | A | A 1 7 | 7.3 | 0.82 | 10.0 | St/BA Polymer | 0.88 | 95.6 | 0.06 |
| Toner 25 | A | A 1 8 | 7.6 | 0.78 | 10.0 | St/BA Polymer | 0.88 | 95.6 | 0.10 |
| Toner 26 | A | A 1 9 | 6.6 | 0.76 | 10.0 | St/BA Polymer | 0.88 | 95.6 | 0.12 |
| Toner 27 | A | A 1 3 | 8.1 | 0.78 | 10.0 | St/BA Polymer | 0.88 | 95.6 | 0.10 |
| Toner 32 | B | A 1 4 | 7.4 | 0.81 | 10.0 | Polyester resin 2 | 0.81 | 64.6 | 0.00 |
| Toner 33 | B | A 1 5 | 7.3 | 0.88 | 10.0 | Polyester resin 2 | 0.81 | 64.6 | −0.07 |
| Toner 34 | B | A11 | 7.4 | 0.77 | 10.0 | Polyester resin 4 | 0.91 | 64.6 | 0.14 |
| Toner 35 | B | A 12 | 7.3 | 0.65 | 10.0 | Polyester resin 4 | 0.91 | 64.6 | 0.26 |
| Toner 36 | B | A 1 5 | 7.4 | 0.88 | 10.0 | Polyester resin 5 | 0.76 | 64.6 | −0.12 |
| Toner 38 | C | A 1 4 | 7.4 | 0.81 | 15.0 | Polyester resin 2 | 0.81 | 64.5 | 0.00 |
| Comparative toner 1 | A | — | — | — | — | St/BA Polymer | 0.88 | 96.5 | — |
| Comparative toner 2 | A | a 1 | 7.3 | 0.43 | 10.0 | St/BA Polymer | 0.88 | 95.6 | 0.45 |
| Comparative toner 3 | A | a 3 | 9.8 | 0.76 | 10.0 | St/BA Polymer | 0.88 | 95.6 | 0.12 |
| Comparative toner 4 | A | a 2 | 5.8 | 0.78 | 10.0 | St/BA Polymer | 0.88 | 95.6 | 0.10 |

In the table, the amount added of the resin A indicates the amount related to 100 parts by mass of the pigment (same hereinbelow).

TABLE 7

| Black | Toner production method | Resin A No. | Resin A pKa | Resin A HPA | Resin A Amount added | Resin B (largest resin component) resin | Resin B HPB | Resin B/ total amount of resin | HPB − HPA |
|---|---|---|---|---|---|---|---|---|---|
| Toner 28 | A | A 1 | 7.3 | 0.78 | 10.0 | St/BA Polymer | 0.88 | 95.6 | 0.10 |
| Toner 37 | B | A 1 | 7.3 | 0.78 | 10.0 | Polyester resin 2 | 0.81 | 64.6 | 0.03 |
| Toner 39 | C | A 1 | 7.3 | 0.78 | 15.0 | Polyester resin 2 | 0.81 | 64.5 | 0.03 |
| Toner 40 | C | A 1 | 7.3 | 0.78 | 25.0 | Polyester resin 2 | 0.81 | 86.0 | 0.03 |
| Toner 41 | C | A 1 | 7.3 | 0.78 | 25.0 | Polyester resin 2 | 0.81 | 86.0 | 0.03 |
| Toner 42 | C | A 1 | 7.3 | 0.78 | 300.0 | Polyester resin 2 | 0.81 | 72.7 | 0.03 |
| Toner 43 | C | A 1 | 7.3 | 0.78 | 500.0 | Polyester resin 2 | 0.81 | 54.5 | 0.03 |
| Comparative toner 5 | A | — | — | — | — | St/BA Polymer | 0.88 | 96.5 | — |
| Comparative toner 6 | A | a 1 | 7.3 | 0.43 | 10.0 | St/BA Polymer | 0.88 | 95.6 | 0.45 |

TABLE 8

| | Toner | Resin A | | | | Resin B | | | |
|---|---|---|---|---|---|---|---|---|---|
| Magenta | production method | No. | pKa | HPA | Amount added | resin | HPB | Resin B/ total amount of resin | HPB − HPA |
| Toner 29 | A | A 1 | 7.3 | 0.78 | 10.0 | St/BA Polymer | 0.88 | 95.6 | 0.10 |
| Toner 30 | A | A 1 | 7.3 | 0.78 | 10.0 | St/BA Polymer | 0.88 | 95.6 | 0.10 |
| Toner 31 | A | A 1 | 7.3 | 0.78 | 10.0 | St/BA Polymer | 0.88 | 95.6 | 0.10 |
| Comparative toner 7 | A | — | — | — | — | St/BA Polymer | 0.88 | 96.5 | — |
| Comparative toner 8 | A | — | — | — | — | St/BA Polymer | 0.88 | 96.5 | — |
| Comparative toner 9 | A | — | — | — | — | St/BA Polymer | 0.88 | 96.5 | — |

Example 1

The toner 1, which was a cyan toner, was evaluated according to the below-described methods for evaluating the tinting strength and lightness.

<Evaluation of Tinting Strength>

A toner placed in a cartridge for a commercial color laser printer Satera LBP7700C (manufactured by Canon Inc.) was drawn out therefrom, the interior was cleaned with an air blower, and a test toner (150 g) was then loaded therein.

The color laser printer was partially remodeled. Thus, the printer was changed to enable the output of an unfixed image by removal of a fixing device, and the image density could be adjusted with a controller. In addition, the printer was remodeled to enable operation when only one-color cartridge is mounted. The removed fixing device was improved to enable the operation thereof as a fixing device unit and was further remodeled as an external fixing device such that the process speed and temperature could be controlled.

The cartridge was mounted on the printer, and after a 30 mm blank space, a 150 mm (width)×30 mm (height) band-shaped image was produced in the upper portion of a transfer material. The controller was set such that the toner laid-on level in the band-shaped image was 0.35 mg/cm$^2$. A4 size GF-C081 (Canon Inc., 81.4 g/m$^2$) was used as the transfer material.

A total of 10 such band-shaped images were output and fixed at a process speed 210 mm/sec and 140° C. by using the external fixing device of LBP7700C.

The tinting strength was evaluated by measuring the image density of the resulting fixed images.

The image density was measured using "Macbeth Reflection Densitometer RD918" (manufactured by Macbeth Corp.). The relative density for a print-out image of a white background portion with an original density of 0.00 was measured, the measurement was performed by 3 points in the left portion, center portion, and right portion with respect to one fixed image, and the evaluation was performed by an arithmetic average value for 10 fixed images. The evaluation criteria are presented below.

A: image density is at least 1.40,
B: image density is at least 1.35 and less than 1.40,
C: image density is at least 1.30 and less than 1.35,
D: image density is at least 1.20 and less than 1.30,
E: image density is less than 1.20.

<Evaluation of Lightness>

Five lightness measurement images with the toner laid-on level adjusted such that the image density of the fixed image was at least 1.29 and nor more than 1.31 were prepared in the abovementioned tinting strength evaluation. The lightness was measured with respect to the lightness measurement images and evaluated by the average value for the five lightness measurement images. The lightness was measured with a spectrophotometric densitometer X-rite eXact Advance (aperture diameter 4.0 mm). The evaluation criteria of lightness are presented below.

A: image lightness is at least 58.0,
B: image lightness is at least 56.0 and less than 58.0,
C: image lightness is at least 54.0 and less than 56.0,
D: image lightness is at least 52.0 and less than 54.0,
E: image lightness is less than 52.0.

<Evaluation of Toner Charge Quantity>

A two-component developer was produced in the following manner to evaluate the charge quantity. A total of 276 g of a ferrite carrier F813-300 (manufactured by Powdertech Co., Ltd.) and 24 g of the evaluation toner were loaded in a plastic bottle, which was equipped with a lid, and shaken for 1 min at a speed of 4 cycles per 1 sec in a shaker (YS-LD: manufactured by Yayoi Co., Ltd.).

A total of 30 g of the resulting developer was sorted out, allowed to stand over 3 days and nights under a high-temperature and high-humidity environment (30° C./80% RH), then placed into a 50 cc resin container, shaken 500 times at 200 cycles/min, and measured using the device shown in FIG. 1. In the evaluation, the charge quantity was measured and determined according to the following criteria.

A rank: not more than −30.0 mC/kg,
B rank: not more than −25.0 mC/kg and more than −30.0 mC/kg,
C rank: not more than −15.0 mC/kg and more than −25.0 mC/kg,
D rank: not more than −10.0 mC/kg and more than −15.0 mC/kg,
E rank: more than −10.0 mC/kg.

(Method for Measuring Charge Quantity)

A total of 0.500 g of a developer for which the friction charge quantity was to be measured was placed in a metal measurement container 2 (see the FIGURE) which had a 500-mesh (mesh opening 25 μm) screen 3 at the bottom, and a metal lid 4 was placed thereon. The mass of the entire measurement container 2 at this time was W1 (g). Next, the pressure of a vacuum meter 5 was set to 250 mmAq by suction from a suction port 7 and adjustment of a suction air quantity adjustment valve 6 in a suction device 1 (at least the portion that was in contact with the measurement container 2 was an insulator). In this state sufficient suction was preferably performed for 2 min and the toner was sucked and removed.

The electric potential measured with a potentiometer 9 at this time was taken as V (volts). Here, the reference numeral 8 stands for a capacitor, and capacitance is denoted by C (μF). The mass of the entire measurement container after suction was taken as W2 (g). The friction charge quantity (mC/kg) of the toner was calculated by the following formula.

$$\text{Friction charge quantity (mC/kg)}=(C\times V)/(W1-W2)$$

<Evaluation of Environmental Stability of Toner Charge Quantity>

The toner charge quantity was measured by the same method as described in the evaluation of toner charge quantity under the aforementioned high-temperature and high-humidity environment, with the exception that the environment in which the developer was allowed to stand was a low-temperature and low-humidity environment (15° C./15% RH, "LL"). The ratio of the charge quantity under the low-temperature and low-humidity environment and under the high-temperature and high-humidity environment [(charge quantity under low-temperature and low-humidity environment)/(charge quantity under high-temperature and high-humidity environment); "LL/HH"] was calculated and determined according to the following criteria.

A rank: not more than 1.20,

B rank: more than 1.20 and not more than 1.30,

C rank: more than 1.30 and not more than 1.40,

D rank: more than 1.40 and not more than 1.50,

E rank: more than 1.50.

Examples 2 to 33 and Comparative Examples 1 to 4

Table 9 shows the evaluation results obtained in Examples 2 to 33 and Comparative Examples 1 to 4 as evaluation results of the cyan toner.

TABLE 9

| | | Tinting strength evaluation | | Lightness evaluation | | Charge quantity under HH | | Environmental stability | |
|---|---|---|---|---|---|---|---|---|---|
| | | Density | Rank | * L | Rank | Charge quantity | Rank | LL/HH | Rank |
| Example 1 | Toner 1 | 1.45 | A | 60.8 | A | −34.5 | A | 1.13 | A |
| Example 2 | Toner 2 | 1.43 | A | 59.9 | A | −34.3 | A | 1.12 | A |
| Example 3 | Toner 3 | 1.41 | A | 59.8 | A | −34.2 | A | 1.14 | A |
| Example 4 | Toner 4 | 1.37 | B | 57.8 | B | −34.3 | A | 1.13 | A |
| Example 5 | Toner 5 | 1.43 | A | 60.0 | A | −34.2 | A | 1.14 | A |
| Example 6 | Toner 6 | 1.35 | B | 57.2 | B | −37.9 | A | 1.22 | B |
| Example 7 | Toner 7 | 1.41 | A | 58.2 | A | −35.6 | A | 1.17 | A |
| Example 8 | Toner 8 | 1.42 | A | 58.4 | A | −33.3 | A | 1.13 | A |
| Example 9 | Toner 9 | 1.39 | B | 58.2 | A | −32.1 | A | 1.14 | A |
| Example 10 | Toner 10 | 1.34 | C | 56.5 | B | −22.5 | C | 1.21 | B |
| Example 11 | Toner 11 | 1.37 | B | 57.2 | B | −26.2 | B | 1.17 | A |
| Example 12 | Toner 12 | 1.4 | A | 59.3 | A | −29.5 | B | 1.16 | A |
| Example 13 | Toner 13 | 1.42 | A | 60.2 | A | −34.5 | A | 1.18 | A |
| Example 14 | Toner 14 | 1.44 | A | 59.8 | A | −37.5 | A | 1.20 | A |
| Example 15 | Toner 15 | 1.44 | A | 59.5 | A | −37.7 | A | 1.24 | B |
| Example 16 | Toner 16 | 1.34 | C | 55.9 | C | −24.1 | C | 1.07 | A |
| Example 17 | Toner 17 | 1.37 | B | 57.5 | B | −26.9 | B | 1.09 | A |
| Example 18 | Toner 18 | 1.41 | A | 59.2 | A | −31.1 | A | 1.11 | A |
| Example 19 | Toner 19 | 1.38 | B | 58.5 | A | −34.5 | A | 1.21 | B |
| Example 20 | Toner 20 | 1.36 | B | 56.5 | B | −35.3 | A | 1.29 | B |
| Example 21 | Toner 21 | 1.42 | A | 60.0 | A | −34.5 | A | 1.14 | A |
| Example 22 | Toner 22 | 1.44 | A | 59.9 | A | −33.9 | A | 1.13 | A |
| Example 23 | Toner 23 | 1.45 | A | 60.2 | A | −34.8 | A | 1.10 | A |
| Example 24 | Toner 24 | 1.38 | B | 57.5 | B | −32.1 | A | 1.15 | A |
| Example 25 | Toner 25 | 1.39 | B | 57.3 | B | −31.1 | A | 1.14 | A |
| Example 26 | Toner 26 | 1.34 | C | 55.2 | C | −17.5 | C | 1.26 | B |
| Example 27 | Toner 27 | 1.37 | B | 55.8 | C | −21.5 | C | 1.22 | B |
| Example 28 | Toner 32 | 1.44 | A | 59.1 | A | −30.4 | A | 1.17 | A |
| Example 29 | Toner 33 | 1.37 | B | 57.5 | B | −30.9 | A | 1.16 | A |
| Example 30 | Toner 34 | 1.39 | B | 58.5 | A | −33.5 | A | 1.18 | A |
| Example 31 | Toner 35 | 1.33 | C | 54.5 | C | −37.3 | A | 1.33 | C |
| Example 32 | Toner 36 | 1.31 | C | 55.4 | C | −32.5 | A | 1.21 | B |
| Example 33 | Toner 38 | 1.44 | A | 60.2 | A | −51.3 | A | 1.22 | B |
| Comparative Example 1 | Comparative toner 1 | 1.26 | D | 54.8 | C | −9.5 | E | 1.25 | B |
| Comparative Example 2 | Comparative toner 2 | 1.23 | D | 53.5 | D | −32.5 | A | 1.18 | A |
| Comparative Example 3 | Comparative toner 3 | 1.27 | D | 54.2 | C | −2.7 | E | 1.39 | C |
| Comparative Example 4 | Comparative toner 4 | 1.24 | D | 54.1 | C | −14.1 | D | 1.41 | D |

Example 34

The tinting strength of the toner 28 which was a black toner was evaluated in the same manner as the tinting strength of the toner 1.

Examples 35 to 40 and Comparative Examples 5 and 6

Likewise, Table 10 shows the evaluation results obtained in Examples 35 to 40 and Comparative Examples 5 and 6 as evaluation results of the black toner.

TABLE 10

| | | Tinting strength evaluation | | Lightness evaluation | | Charge quantity under HH | | Environmental stability | |
|---|---|---|---|---|---|---|---|---|---|
| | | Density | Rank | * L | Rank | Charge quantity | Rank | LL/HH | Rank |
| Example 34 | Toner 28 | 1.45 | A | Not evaluated | | −30.2 | A | 1.18 | A |
| Example 35 | Toner 37 | 1.43 | A | | | −30.6 | A | 1.19 | A |
| Example 36 | Toner 39 | 1.40 | A | | | −19.8 | C | 1.23 | B |
| Example 37 | Toner 40 | 1.42 | A | | | −24.7 | C | 1.29 | B |
| Example 38 | Toner 41 | 1.37 | B | | | −25.4 | B | 1.31 | C |
| Example 39 | Toner 42 | 1.41 | A | | | −31.1 | A | 1.37 | C |
| Example 40 | Toner 43 | 1.41 | A | | | −31.0 | A | 1.39 | C |
| Comparative Example 5 | Comparative toner 5 | 1.22 | D | | | −8.8 | E | 1.29 | B |
| Comparative Example 6 | Comparative toner 6 | 1.19 | E | | | −30.4 | A | 1.17 | A |

Example 41

The tinting strength and lightness of the toner 29 which was a magenta toner were evaluated in the same manner as the tinting strength and lightness of the toner 1.

Examples 42 and 43 and Comparative Examples 7 to 9

Likewise, Table 11 shows the evaluation results obtained in Examples 42 and 43 and Comparative Examples 7 to 9 as evaluation results of the magenta toner.

TABLE 11

| | | Tinting strength evaluation | | Lightness evaluation | | Charge quantity under HH | | Environmental stability | |
|---|---|---|---|---|---|---|---|---|---|
| | | Density | Rank | * L | Rank | Charge quantity | Rank | LL/HH | Rank |
| Example 41 | Toner 29 | 1.39 | B | 56.8 | B | −31.5 | A | 1.21 | B |
| Example 42 | Toner 30 | 1.41 | A | 58.1 | A | −30.4 | A | 1.19 | A |
| Example 43 | Toner 31 | 1.37 | B | 56.5 | B | −31.1 | A | 1.18 | A |
| Comparative Example 7 | Comparative toner 7 | 1.19 | E | 53.3 | D | −6.9 | E | 1.17 | A |
| Comparative Example 8 | Comparative toner 8 | 1.21 | D | 53.5 | D | −9.6 | E | 1.21 | B |
| Comparative Example 9 | Comparative toner 9 | 1.2 | D | 53.6 | D | −8.8 | E | 1.18 | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-055202, filed Mar. 18, 2016, which is hereby incorporated by reference herein in its entirety.

What is claimed is:

1. A toner comprising a toner particle containing:

a binder resin;

a resin A; and a pigment, wherein the resin A has a pKa of 6.0 to 9.0 where pKa represents an acid dissociation constant measured by preparing a resin solution in which 1.0 part by mass of the resin A, 70.0 parts by mass of toluene and 30.0 parts by mass of ethanol are mixed, and carrying out neutralization titration with a 0.1 mol/L potassium hydroxide ethanol solution, and the resin A has a hydrophobic parameter HPA of 0.65 to 0.95 where HPA represents a volume fraction of heptane at a point of precipitation by the resin A as measured by the addition of heptane to a solution containing 0.01 parts by mass of the resin A and 1.48 parts by mass of chloroform.

2. The toner according to claim 1, wherein the resin A has a structure represented by formula (1)

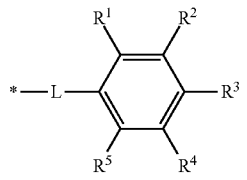

(1)

where one of $R^2$ and $R^3$ is a carboxyl group; $R^1$, $R^2$, $R^3$, $R^4$, and $R^5$ other than the carboxyl group are independently a hydrogen atom, a hydroxyl group, an amino group, an alkoxy group having 1 to 8 carbon atoms, or an alkyl group having 1 to 8 carbon atoms; L is a linker group represented by formula (2); and * represents a segment bonded to a main chain skeleton of the resin A, (2)

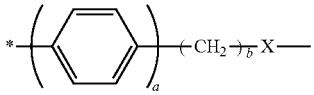

where a is 0 or 1, and b is an integer of 0 to 4; X is a single bond or a group represented by —O—, —S—, or —$NR^6$—; $R^6$ is a hydrogen atom or an alkyl group having 1 to 4 carbon atoms; and * represents a segment bonded to the main chain skeleton of the resin A.

3. The toner according to claim 2, wherein the structure represented by the formula (1) is a structure represented by formula (3)

(3)

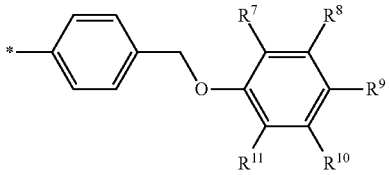

where one of $R^8$ and $R^9$ is a carboxyl group, and the other is a hydroxyl group; $R^7$, $R^{10}$, and $R^{11}$ are independently a hydrogen atom, a hydroxyl group, an amino group, an alkoxy group having 1 to 4 carbon atoms, or an alkyl group having 1 to 4 carbon atoms; and * represents a segment bonded to the main chain skeleton of the resin A.

4. The toner according to claim 1, wherein the resin A has an acid value of 3.0 to 25.0 mg KOH/g.

5. The toner according to claim 1, wherein a content of the resin A is 3.0 to 30.0 parts by mass per 100 parts by mass of the pigment.

6. The toner according to claim 1, wherein a weight-average molecular weight of the resin A is 10,000 to 75,000.

7. The toner according to claim 1, wherein the resin A has the pKa of 7.0 to 8.0.

8. The toner according to claim 1, wherein the binder resin includes at least 50 parts by mass of a resin B when a resin component in the toner is taken as 100 parts by mass, and a difference (HPB−HPA) between the hydrophobic parameter HPA of the resin A and a hydrophobic parameter HPB of the resin B is 0.10 to 0.25, where HPB represents a volume fraction of heptane at a point of precipitation by the resin B as measured by the addition of heptane to a solution containing 0.01 parts by mass of the resin B and 1.48 parts by mass of chloroform.

9. The toner according to claim 1, wherein the pigment is at least one selected from the group consisting of carbon black, a phthalocyanine pigment, a quinacridone pigment, a pyrrolopyrrole pigment, a perylene pigment, an anthraquinone pigment, and an isoindoline pigment.

10. The toner according to claim 1, wherein the resin A has an alkoxycarbonyl group represented by formula (5)

(5)

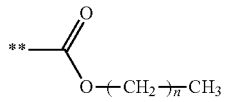

in the formula (5), n is 3 to 21; and ** represents a segment bonded to a main chain skeleton of the resin A.

11. A method for producing a toner comprising a toner particle containing a binder resin, a resin A and a pigment, the method comprising step (i) or (ii):

(i) a step of producing the toner particle by granulating, in an aqueous medium, a polymerizable monomer composition containing the resin A, the pigment, and a vinyl polymerizable monomer capable of forming the binder resin, and polymerizing the vinyl polymerizable monomer contained in the polymerizable monomer composition; and (ii) a step of producing the toner particle by granulating, in an aqueous medium, an organic solvent dispersion containing the binder resin, the resin A, and the pigment in an organic solvent, wherein the resin A has a pKa of 6.0 to 9.0 where pKa represents an acid dissociation constant measured by preparing a resin solution in which 1.0 part by mass of the resin A, 70.0 parts by mass of toluene and 30.0 parts by mass of ethanol are mixed, and carrying out neutralization titration with a 0.1 mol/L potassium hydroxide ethanol solution, and the resin A has a hydrophobic parameter HPA of 0.65 to 0.95 HPA represents a volume fraction of heptane at a point of precipitation by the resin A as measured by the addition of heptane to a solution containing 0.01 parts by mass of the resin A and 1.48 parts by mass of chloroform.

12. A toner comprising a toner particle containing:

a binder resin;

a pigment; and a resin A, wherein the resin A has a hydrophobic parameter HPA of 0.65 to 0.95, where HPA represents a volume fraction of heptane at a point of precipitation by the resin A as measured by the addition of heptane to a solution containing 0.01 parts by mass of the resin A and 1.48 parts by mass of chloroform, and the resin A has a structure represented by formula (3)

(3)

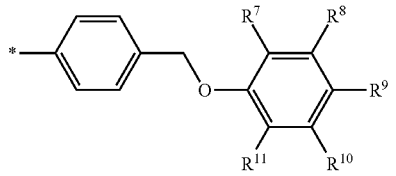

where one of $R^8$ and $R^9$ is a carboxyl group, and the other is a hydroxyl group; $R^7$, $R^{10}$, and $R^{11}$ are independently a hydrogen atom, a hydroxyl group, an amino group, an alkoxy group having 1 to 4 carbon atoms, or an alkyl group having 1 to 4 carbon atoms; and * represents a segment bonded to a main chain skeleton of the resin A.

* * * * *